US006670925B2

(12) United States Patent
Iwai et al.

(10) Patent No.: US 6,670,925 B2
(45) Date of Patent: Dec. 30, 2003

(54) INVERTED F-TYPE ANTENNA APPARATUS AND PORTABLE RADIO COMMUNICATION APPARATUS PROVIDED WITH THE INVERTED F-TYPE ANTENNA APPARATUS

(75) Inventors: Hiroshi Iwai, Kobe (JP); Atsushi Yamamoto, Osaka (JP); Koichi Ogawa, Hirakata (JP); Shinji Kamaeguchi, Kadoma (JP); Kenichi Yamada, Yokohama (JP); Tsukasa Takahashi, Kawasaki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/156,073

(22) Filed: May 29, 2002

(65) Prior Publication Data

US 2002/0186169 A1 Dec. 12, 2002

(30) Foreign Application Priority Data

Jun. 1, 2001 (JP) ..... P2001-166578

(51) Int. Cl.[7] ..... H01Q 1/24
(52) U.S. Cl. ..... 343/702; 343/700 MS
(58) Field of Search ..... 343/702, 700 MS, 343/846, 767, 860

(56) References Cited

U.S. PATENT DOCUMENTS 5,764,190 A * 6/1998 Murch et al. ..... 343/702
6,008,764 A * 12/1999 Ollikainen et al. .. 343/700 MS
6,259,407 B1 * 7/2001 Tran ..... 343/700 MS
6,297,776 B1 * 10/2001 Pankinaho ..... 343/700 MS

* cited by examiner

*Primary Examiner*—Hoang V. Nguyen
(74) *Attorney, Agent, or Firm*—Wenderoth, Lind & Ponack, L.L.P.

(57) ABSTRACT

An inverted F-type antenna apparatus is provided with a grounding conductor and an antenna element arranged on the grounding conductor so as to face the grounding conductor. The inverted F-type antenna apparatus further includes at least one coupling element provided between the grounding conductor and the antenna element so as to face the grounding conductor and the antenna element, and a connection conductor is provided for electrically connecting the antenna element with the grounding conductor at least in one place. In the inverted F-type antenna apparatus, the grounding conductor, the antenna element and the coupling element are arranged so as to be substantially parallel to each other.

40 Claims, 28 Drawing Sheets

FIRST PREFERRED EMBODIMENT

SECOND PREFERRED EMBODIMENT

FIRST MODIFIED PREFERRED EMBODIMENT
OF SECOND PREFERRED EMBODIMENT

SECOND MODIFIED PREFERRED EMBODIMENT OF SECOND PREFERRED EMBODIMENT

THIRD MODIFIED PREFERRED EMBODIMENT OF SECOND PREFERRED EMBODIMENT

FOURTH MODIFIED PREFERRED EMBODIMENT OF SECOND PREFERRED EMBODIMENT

THIRD PREFERRED EMBODIMENT

FIRST MODIFIED PREFERRED EMBODIMENT OF THIRD PREFERRED EMBODIMENT

SECOND MODIFIED PREFERRED EMBODIMENT OF THIRD PREFERRED EMBODIMENT

THIRD MODIFIED PREFERRED EMBODIMENT OF THIRD PREFERRED EMBODIMENT

FOURTH MODIFIED PREFERRED EMBODIMENT OF THIRD PREFERRED EMBODIMENT

FOURTH PREFERRED EMBODIMENT

FIFTH PREFERRED EMBODIMENT

MODIFIED PREFERRED EMBODIMENT
OF FIFTH PREFERRED EMBODIMENT

SIXTH PREFERRED EMBODIMENT

FIRST MODIFIED PREFERRED EMBODIMENT OF SIXTH PREFERRED EMBODIMENT

THIRD MODIFIED PREFERRED EMBODIMENT OF SIXTH PREFERRED EMBODIMENT

SECOND MODIFIED PREFERRED EMBODIMENT OF SIXTH PREFERRED EMBODIMENT

SEVENTH PREFERRED EMBODIMENT

FIRST MODIFIED PREFERRED EMBODIMENT OF SEVENTH PREFERRED EMBODIMENT

SECOND MODIFIED PREFERRED EMBODIMENT OF SEVENTH PREFERRED EMBODIMENT

EIGHTH PREFERRED EMBODIMENT

Fig.27A NINTH PREFERRED EMBODIMENT

MODIFIED PREFERRED EMBODIMENT OF NINTH PREFERRED EMBODIMENT

TENTH PREFERRED EMBODIMENT

ELEVENTH PREFERRED EMBODIMENT

INVERTED F-TYPE ANTENNA APPARATUS AND PORTABLE RADIO COMMUNICATION APPARATUS PROVIDED WITH THE INVERTED F-TYPE ANTENNA APPARATUS

BACKGROUND OF THE INVENTION

1. Field of the Invention

The present invention relates to an inverted F-type antenna apparatus and a potable radio communication apparatus provided with the inverted F-type antenna apparatus, and in particular, to an inverted F-type antenna apparatus for portable radio communication apparatuses mainly for mobile communications, such as a portable telephone, and to a portable radio communication apparatus provided with the above-mentioned inverted F-type antenna apparatus.

2. Description of the Prior Art

In recent years, a mobile communication system using portable radio communication apparatuses, such as a portable telephone, has been rapidly developed. This portable telephone has been changed from the positioning thereof as a conventional audio terminal apparatus to an information terminal apparatus for performing transmission of data and images. In accordance with this, a folding type portable telephone, which is more suitable for increasing the size of the screen, has been widely used.

FIG. 31A is a plan view showing a construction of a portable radio communication apparatus 1001, which is a straight type portable telephone according to a prior art, and FIG. 31B is a plan view schematically showing a construction of a dielectric substrate 1004 provided with an inverted F-type antenna apparatus 1005 of FIG. 31A.

Referring to FIG. 31A, a liquid crystal display section 1003 is provided near the upper side of the center portion of a housing 1002 of the portable radio communication apparatus 1001, while a dielectric substrate 1004 is provided throughout the entire space inside of the housing 1002. In this case, the built-in antenna 1005 is arranged above the dielectric substrate 1004. As shown in FIG. 31B, this built-in antenna 1005 is constructed of a rectangular flat-plate-shaped antenna element 1006, a columnar pin-shaped short-circuit conductor 1007 for connecting the antenna element 1006 with a grounding conductor (not shown) and a columnar pin-shaped feeding conductor 1008 for connecting the antenna element 1006 with a feeding coaxial cable (not shown) at a feeding point. The built-in antenna 1005 is normally constructed of a low-height small-size inverted F-type antenna apparatus called a planar inverted F antenna (PIFA). This inverted F-type antenna apparatus, which is an unbalanced type antenna, therefore operates as an antenna with a large current flowing through the grounding conductor formed on the rear surface of the dielectric substrate 1004. In this case, current standing waves are generated when a dimension obtained by adding the length in the direction of the longer side of the grounding conductor to the length in the direction of the shorter side of the grounding conductor is greater than ¼ with respect to the wavelength 1 of the frequency band of the radio wave which is used, and therefore, a wideband characteristic can be obtained.

However, in the case of the built-in inverted F-type antenna apparatus of the folding type portable radio communication apparatus, the dimension of the dielectric substrate, i.e., the dimension of the grounding conductor is disadvantageously reduced in comparison with that of the built-in inverted F-type antenna apparatus of the straight type portable radio communication apparatus 1001. In this case, when the frequency band of the radio wave which is used is comparatively low, the dimension obtained by adding the length in the direction of the longer side of the grounding conductor and the length in the direction of the shorter side of the grounding conductor becomes smaller than ¼ with respect to the wavelength 1 of the frequency band of the radio wave which is used. Consequently, there has been such a problem that the grounding conductor stops contributing to the excitation of the antenna, disadvantageously leading to a narrow-band characteristic.

SUMMARY OF THE INVENTION

An object of the present invention is to solve the aforementioned problems and provide an inverted F-type antenna apparatus which is built in a folding type portable radio communication apparatus, the antenna apparatus being capable of achieving a comparatively wideband characteristic even when the frequency band of the radio wave which is used is comparatively low and the grounding conductor does not contribute to the excitation of the antenna, as well as a portable radio communication apparatus that employs the antenna apparatus.

Another object of the present invention is to provide an antenna apparatus which is built in a folding type portable radio communication apparatus, the antenna apparatus being capable of reducing the influence from a human body and reducing the radiation loss of the antenna apparatus, as well as a portable radio communication apparatus that employs the antenna apparatus.

In order to achieve the aforementioned objective, according to one aspect of the present invention, there is provided an inverted F-type antenna apparatus including a grounding conductor, an antenna element arranged on the grounding conductor so as to face the grounding conductor, and at least one coupling element provided between the grounding conductor and the antenna element so as to face the grounding conductor and the antenna element. The inverted F-type antenna apparatus further includes first connection means for electrically connecting the antenna element with the grounding conductor at least in one place.

In the above-mentioned inverted F-type antenna apparatus, the grounding conductor, the antenna element and the coupling element are arranged so as to be substantially parallel to each other.

In the above-mentioned inverted F-type antenna apparatus, the antenna element and the grounding conductor are preferably arranged so that a distance between the antenna element and the grounding conductor in an end portion where the antenna element and the grounding conductor are electrically connected with each other by the first connection means is different from a distance between the antenna element and the grounding conductor in another end portion located opposite to the end portion.

In the above-mentioned inverted F-type antenna apparatus, the coupling element is preferably arranged so as to be inclined with respect to the grounding conductor.

In the above-mentioned inverted F-type antenna apparatus, the antenna element preferably has a shape curved along a configuration of a housing for accommodating the inverted F-type antenna apparatus.

In the above-mentioned inverted F-type antenna apparatus, at least one of the coupling element and the antenna element is preferably provided with a bent portion.

In the above-mentioned inverted F-type antenna apparatus, the grounding conductor is preferably provided with a bent portion.

In the above-mentioned inverted F-type antenna apparatus, a length of a sum total of lengths of two mutually different sides of the grounding conductor is preferably equal to or smaller than a quarter of a wavelength corresponding to a lowest frequency band among frequency bands which are used by a portable radio communication apparatus that employs the inverted F-type antenna apparatus.

The above-mentioned inverted F-type antenna apparatus preferably further includes second connection means for electrically connecting the antenna element with the coupling element at least in one place.

In the above-mentioned inverted F-type antenna apparatus, a connecting point of the second connection means is preferably arranged near a connecting point of the first connection means.

In the above-mentioned inverted F-type antenna apparatus, dimensions of the antenna element and the coupling element are preferably set so that the connecting point of the second connection means is located substantially in a portion of an anti-node of a current standing wave generated in the antenna element and the coupling element, and the coupling element operates as a quarter-wave length resonator when the inverted F-type antenna apparatus is excited by a radio signal of a predetermined wavelength.

In the above-mentioned inverted F-type antenna apparatus, the antenna element and the coupling element are preferably electrically connected with each other by a common feeding conductor.

In the above-mentioned inverted F-type antenna apparatus, the antenna element and the coupling element are preferably electrically connected with each other by a common short-circuit conductor.

In the above-mentioned inverted F-type antenna apparatus, a resonance frequency of the inverted F-type antenna apparatus is preferably adjusted by forming a slit in the antenna element.

In the above-mentioned inverted F-type antenna apparatus, a resonance frequency of the inverted F-type antenna apparatus is preferably adjusted by forming a slit in the coupling element.

In the above-mentioned inverted F-type antenna apparatus, a resonance frequency of the inverted F-type antenna apparatus is preferably adjusted by forming a slot in the antenna element.

In the above-mentioned inverted F-type antenna apparatus, a resonance frequency of the inverted F-type antenna apparatus is preferably adjusted by forming a slot in the coupling element.

In the above-mentioned inverted F-type antenna apparatus, an amount of electromagnetic coupling between the antenna element and the grounding conductor is preferably adjusted by changing an area of at least one of the antenna element and the coupling element.

In the above-mentioned inverted F-type antenna apparatus, a dielectric is preferably filled in either one of a part of internal portion and the whole portion of the inverted F-type antenna apparatus.

In the above-mentioned inverted F-type antenna apparatus, dimensions of the antenna element and the coupling element are preferably set so that the inverted F-type antenna apparatus resonates in a plurality of frequency bands.

According to another aspect of the present invention, there is provided a portable radio communication apparatus including an upper housing, a lower housing, a hinge portion for coupling the upper housing with the lower housing, and the above-mentioned inverted F-type antenna apparatus. In the portable radio communication apparatus, the inverted F-type antenna apparatus is arranged inside of the upper housing.

The above-mentioned portable radio communication apparatus preferably further includes a monopole antenna.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

Figure 11:
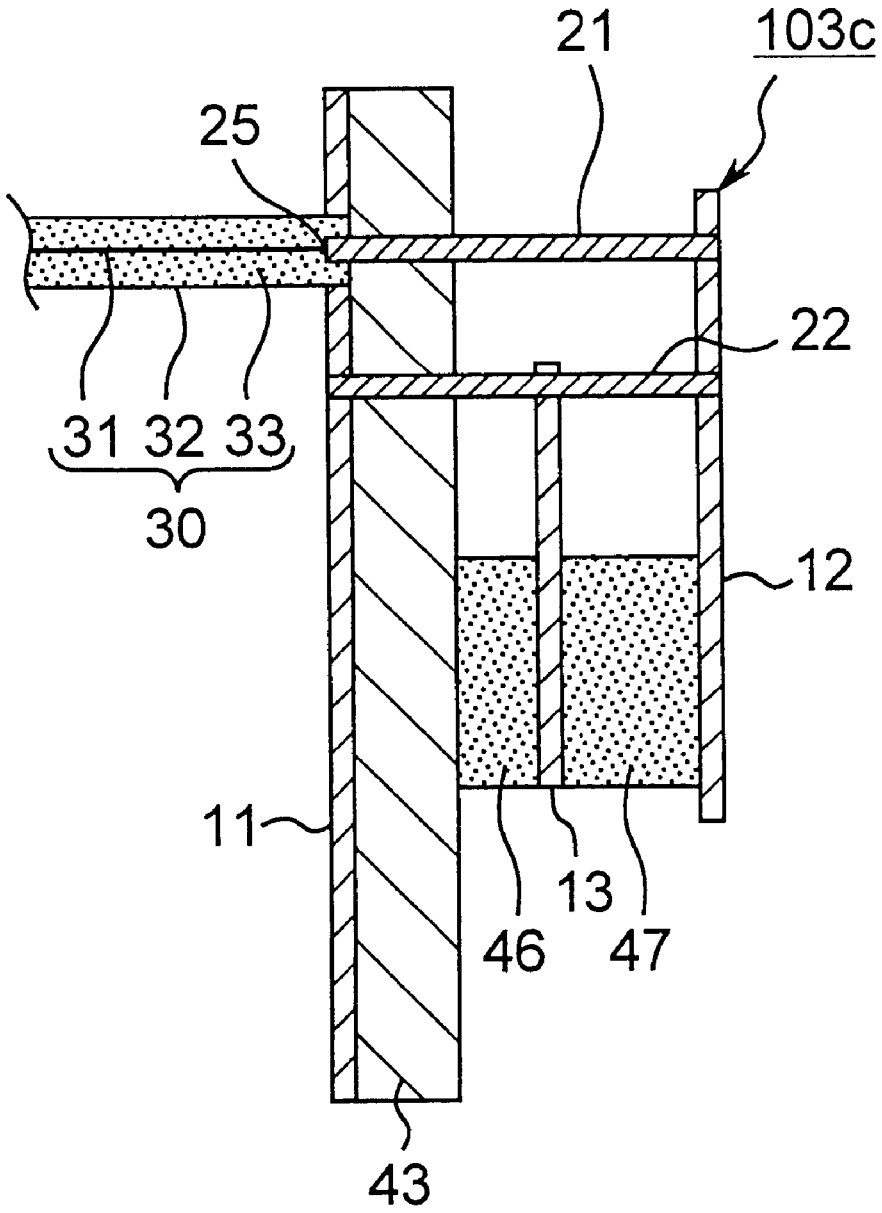
Figure 12:
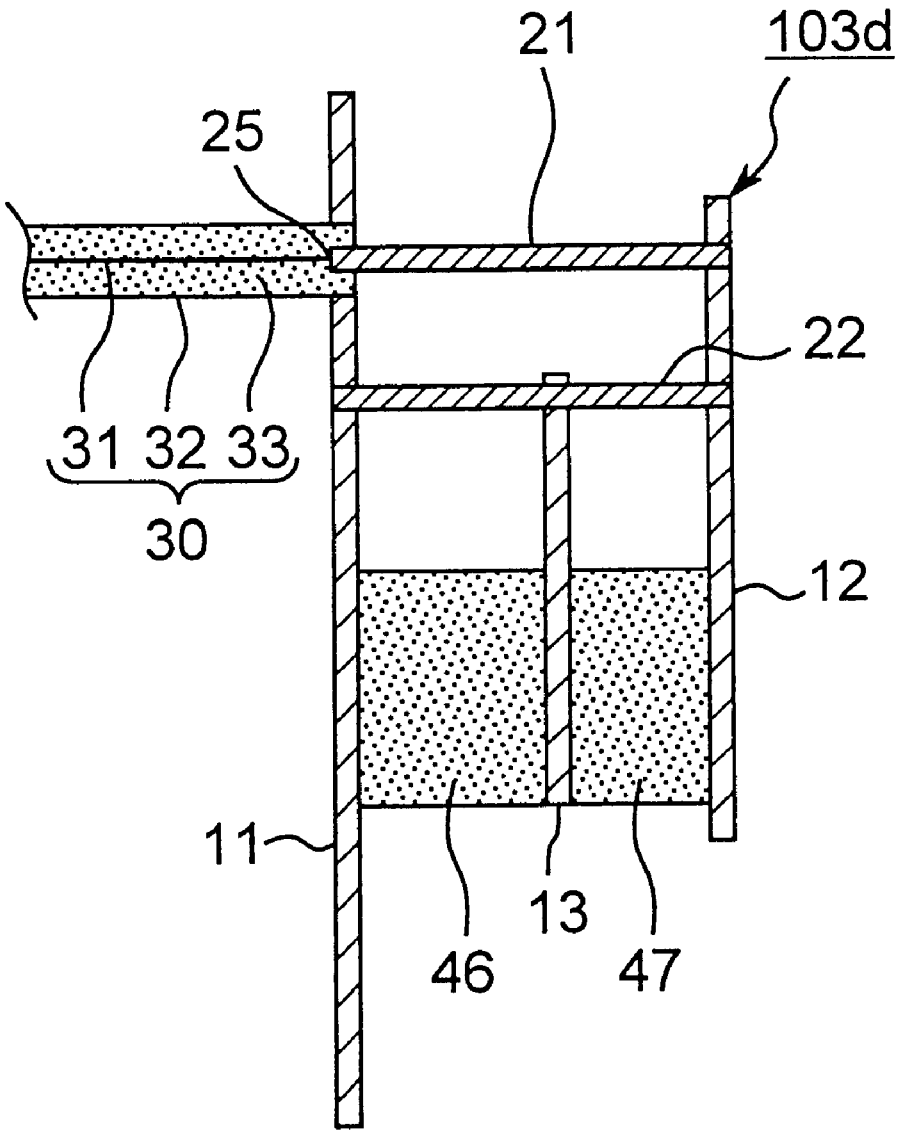
Figure 13B:
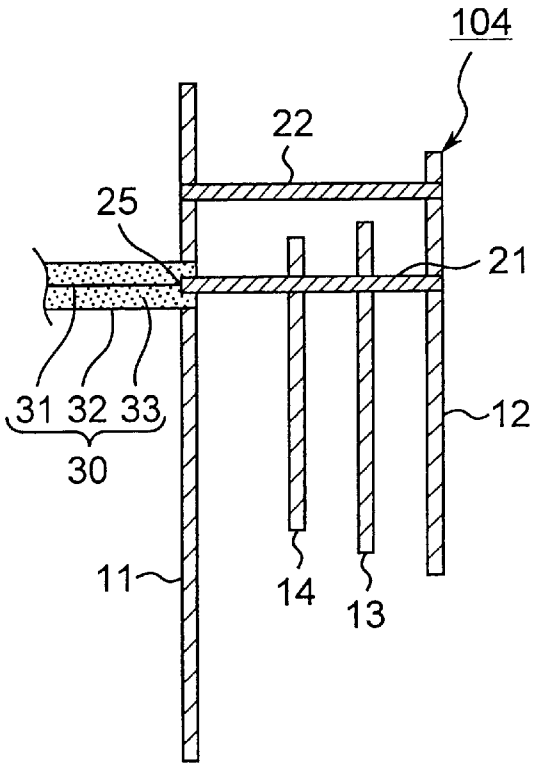
Figure 13A:
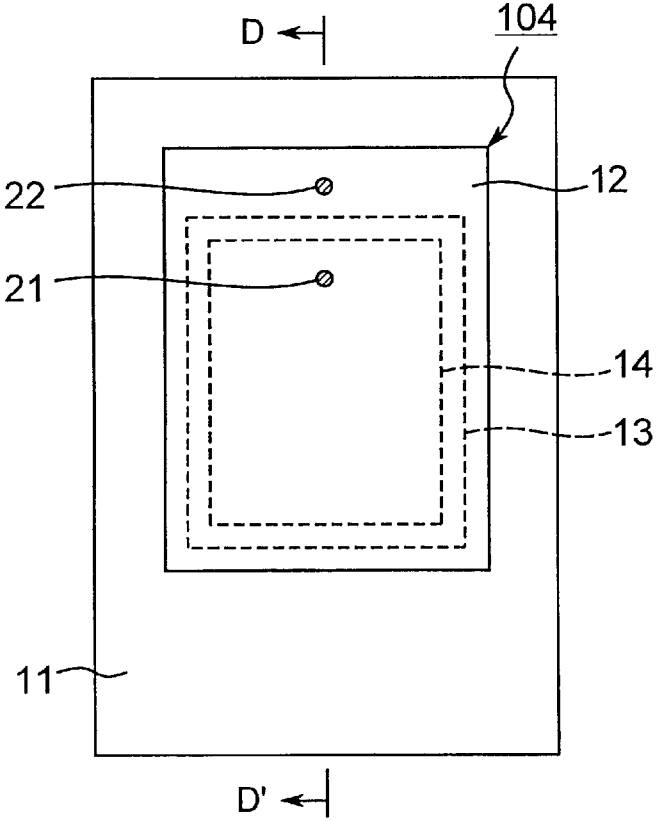
Figure 14B:
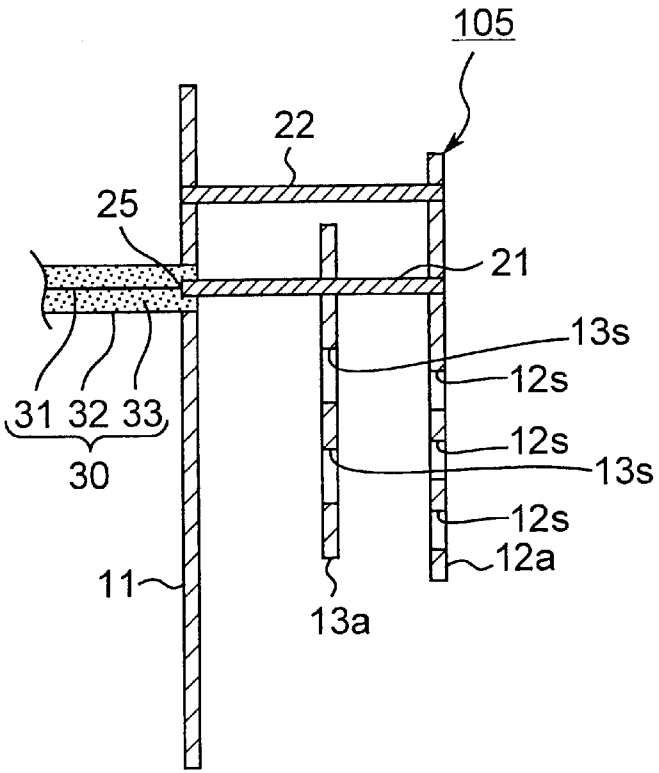
Figure 14A:
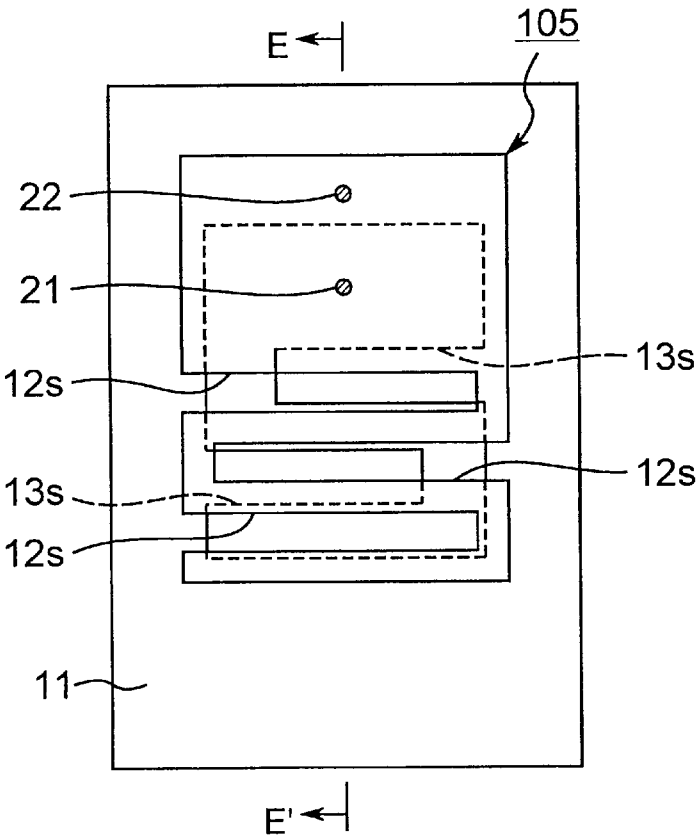
Figure 15B:
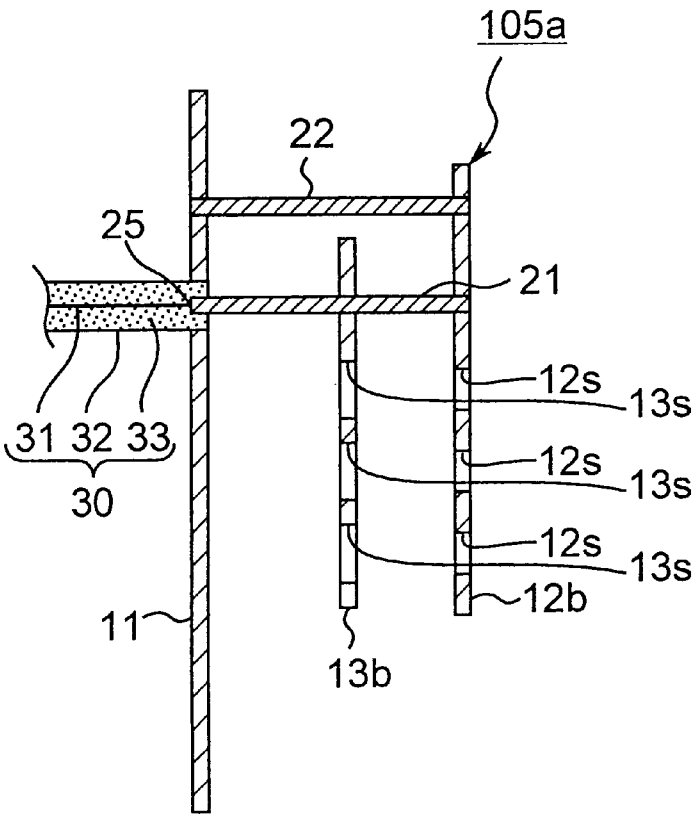
Figure 15A:
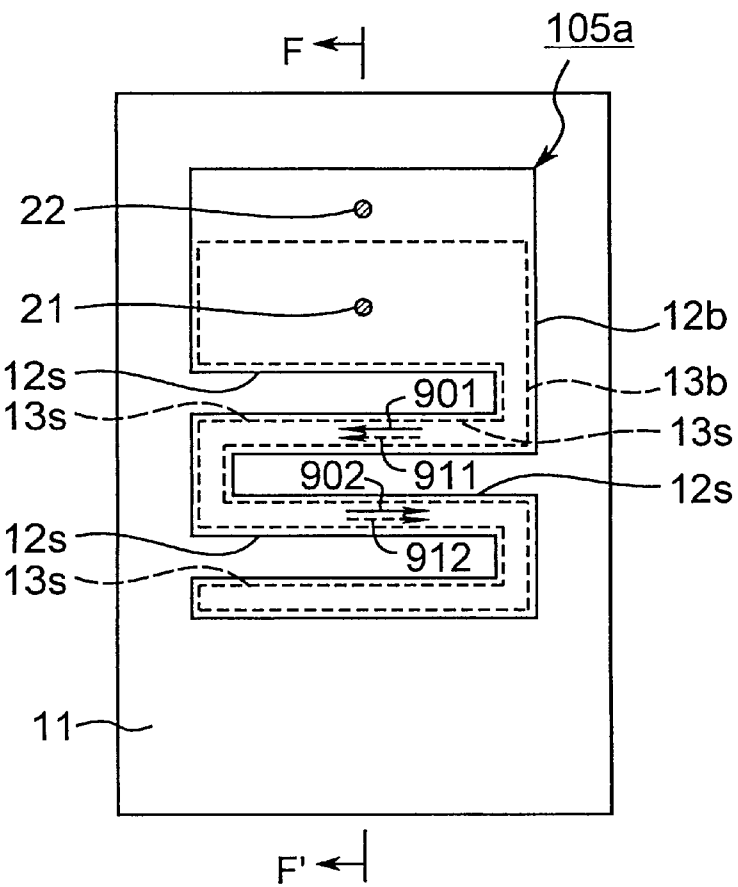
Figure 16B:
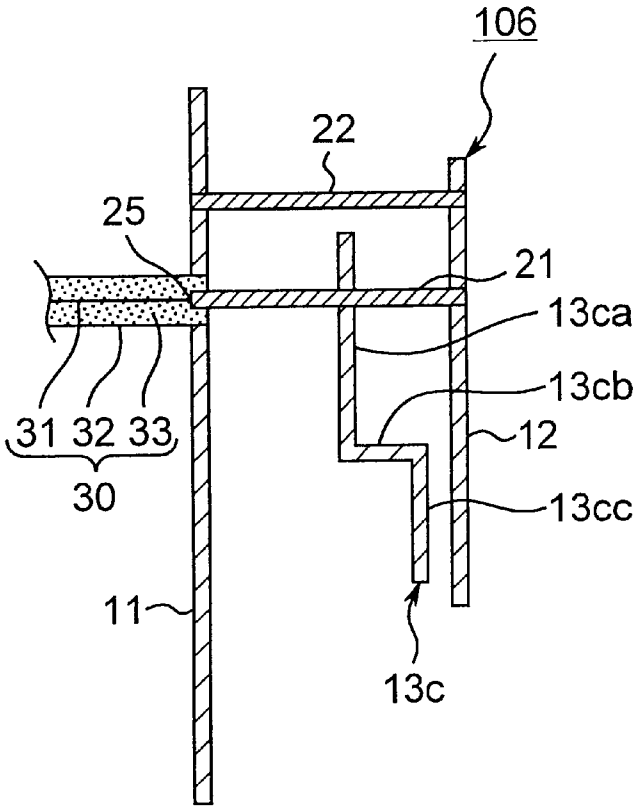
Figure 16A:
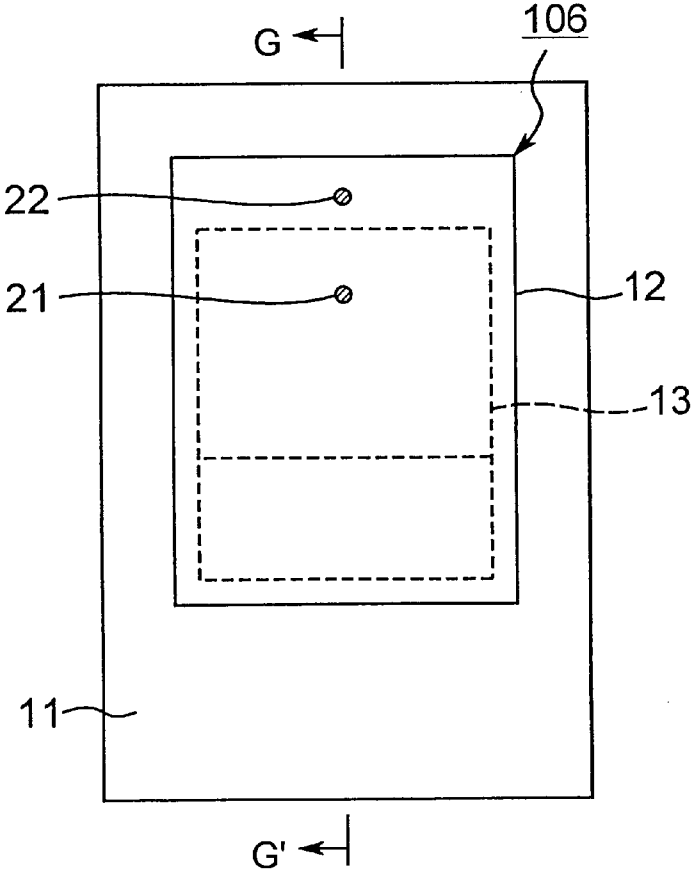
Figure 17B:
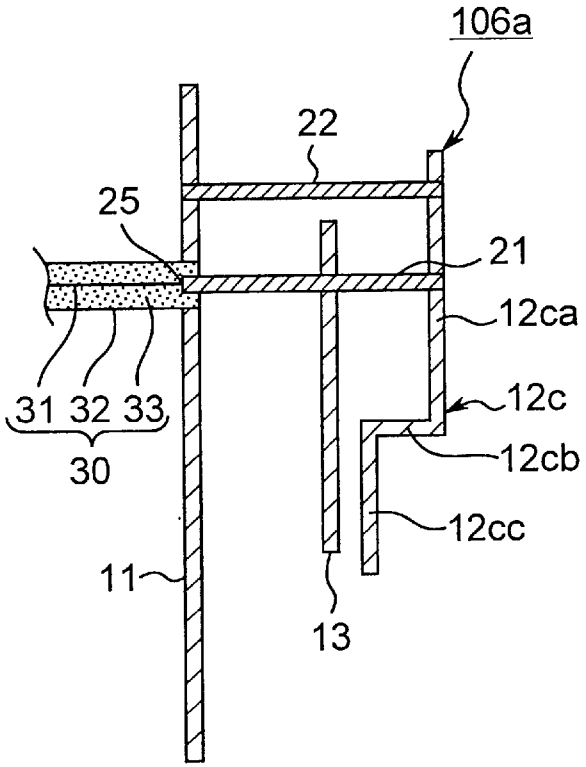
Figure 17A:
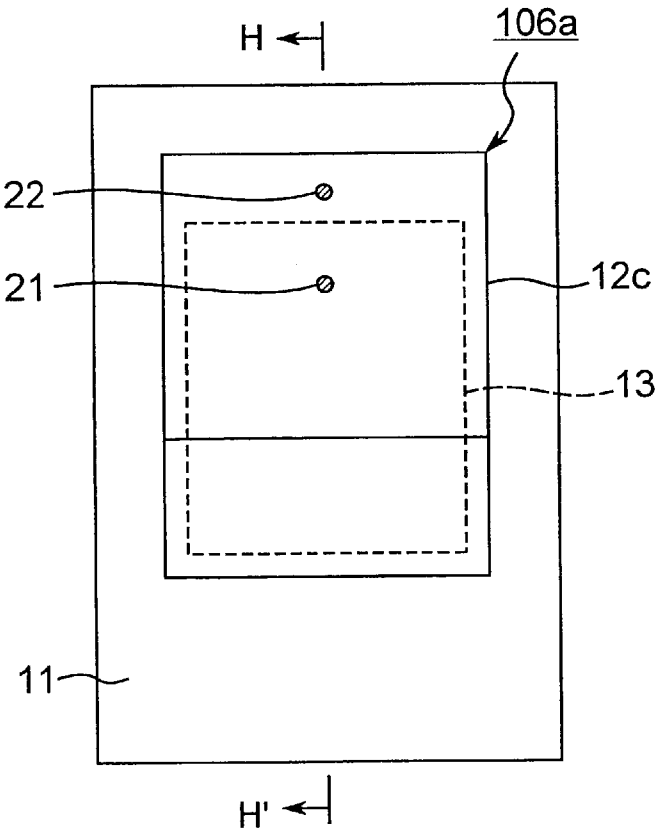
Figure 19:
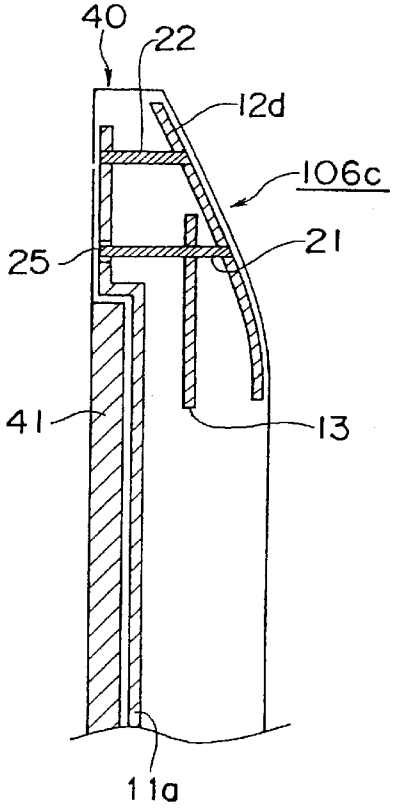
Figure 18:
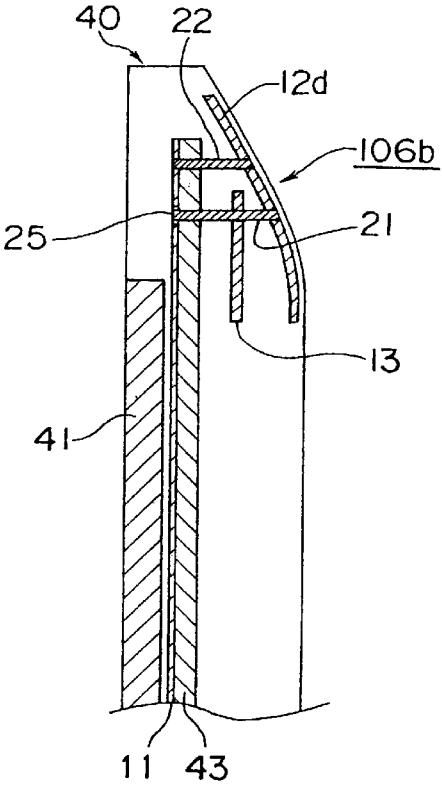
Figure 20A:
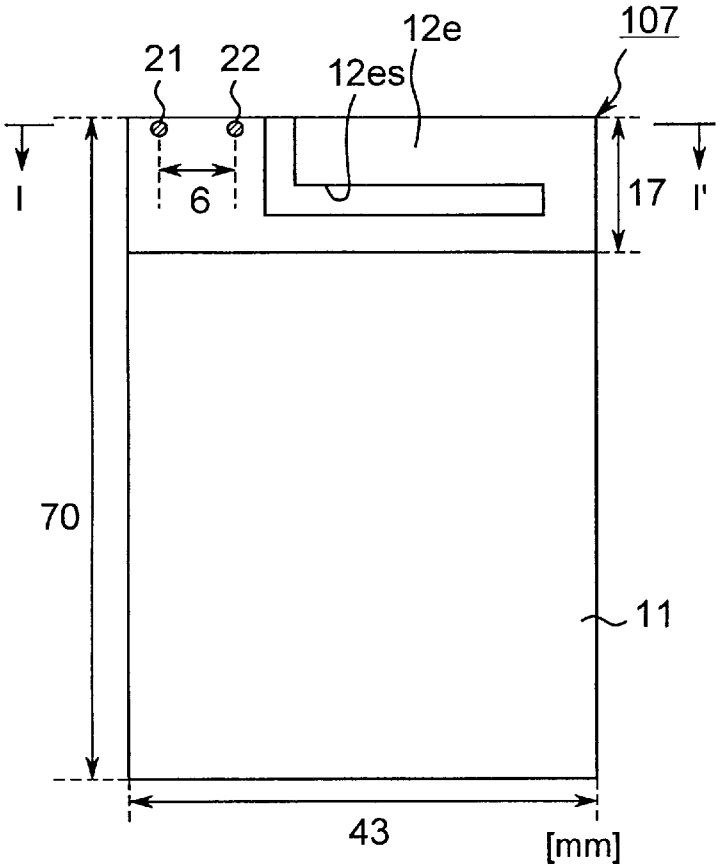
Figure 20B:
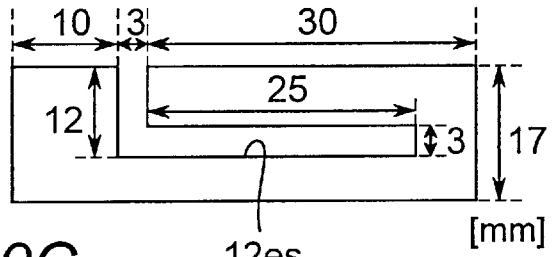
Figure 20C:
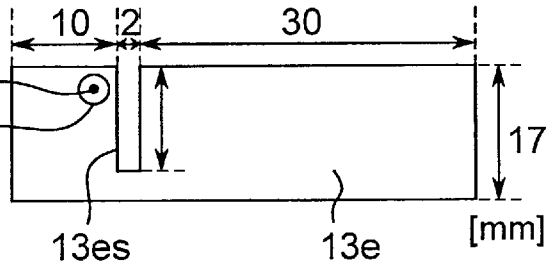
Figure 20D:
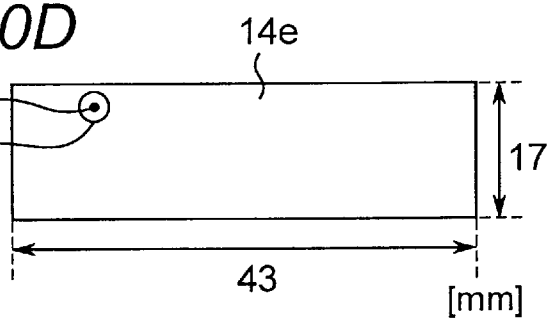
Figure 21:
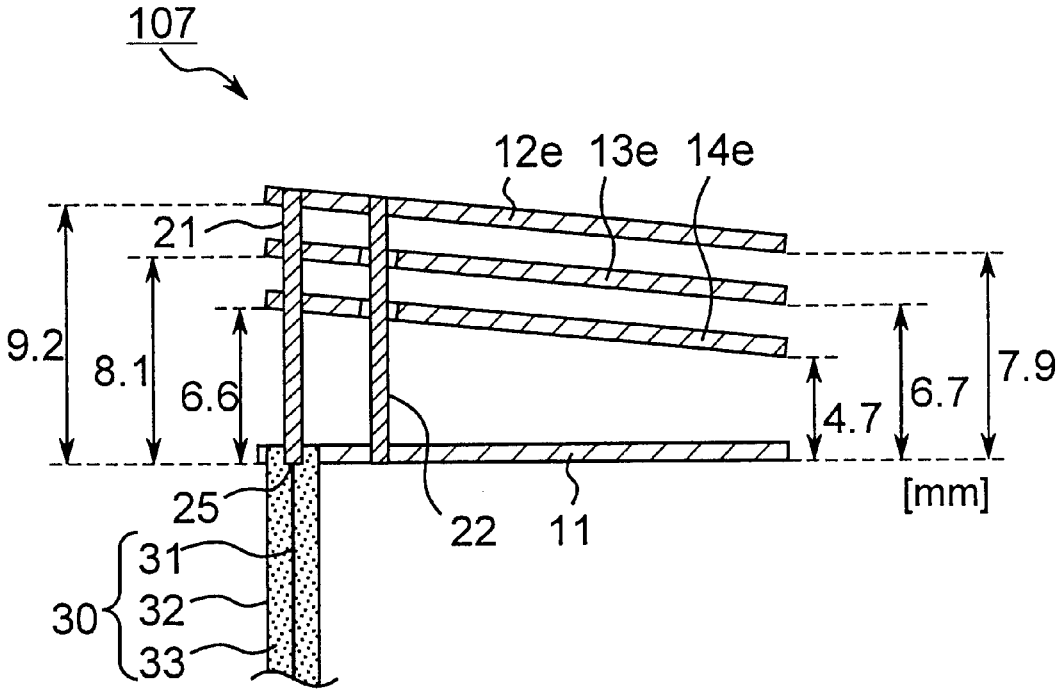
Figure 22:
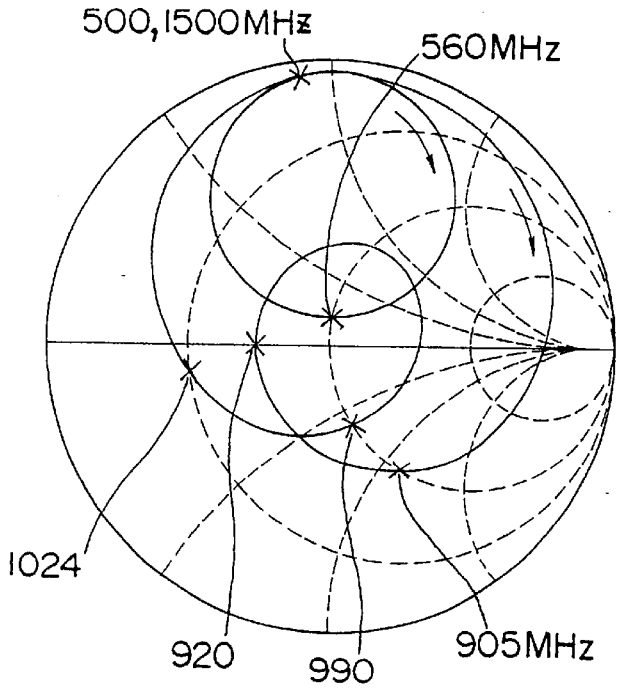
Figure 23:
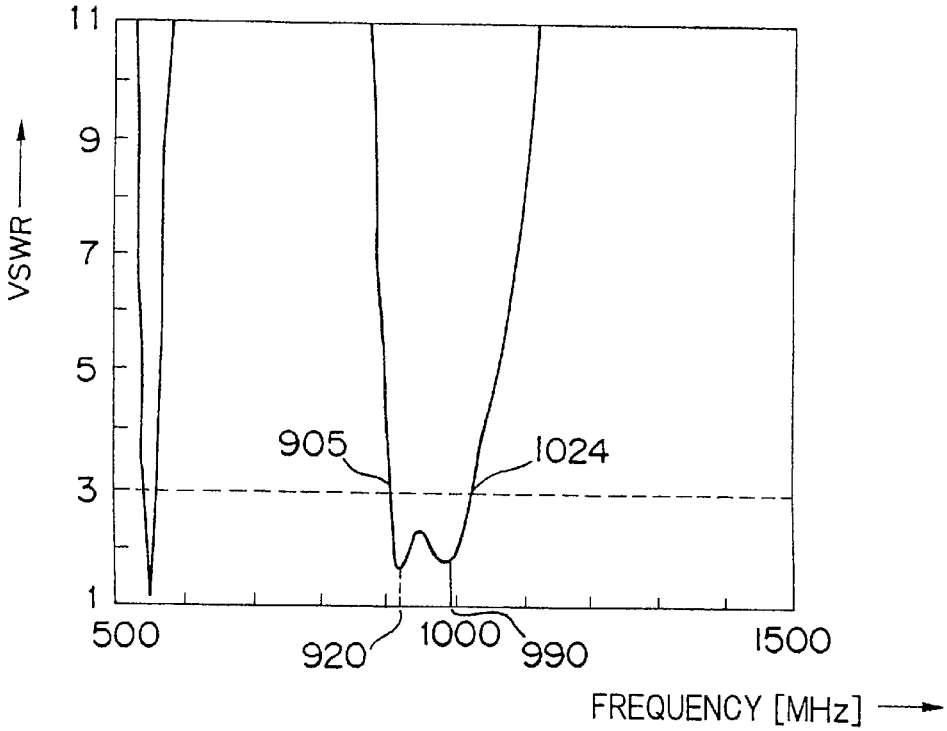
Figure 24:
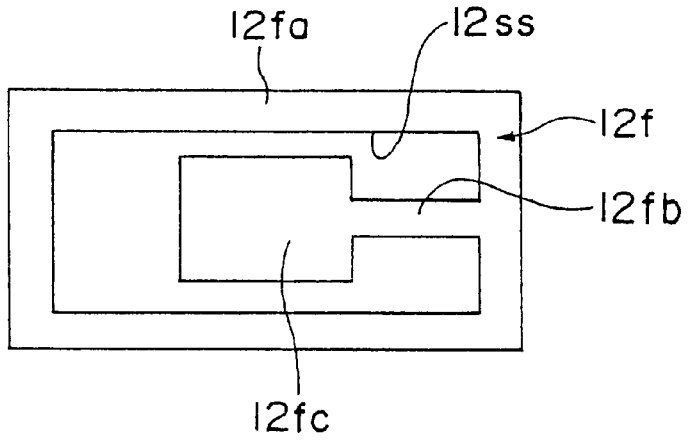
Figure 25:
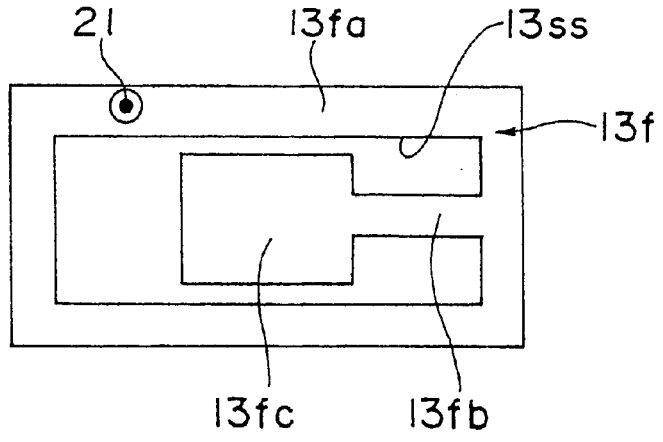
Figure 26B:
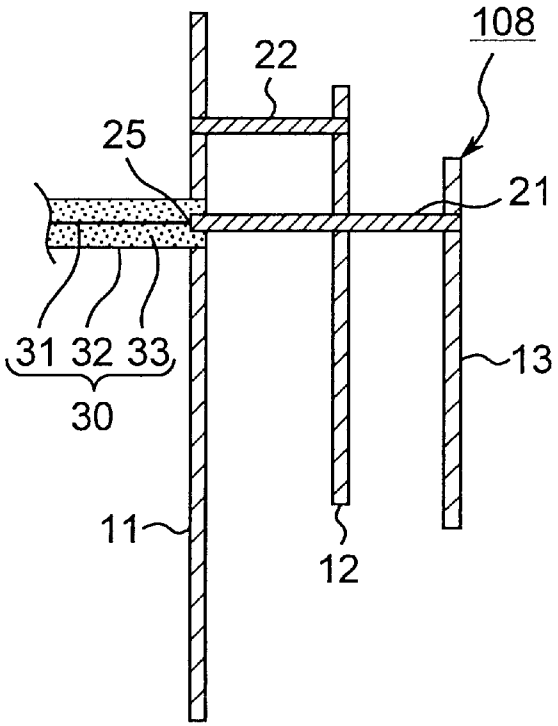
Figure 26A:
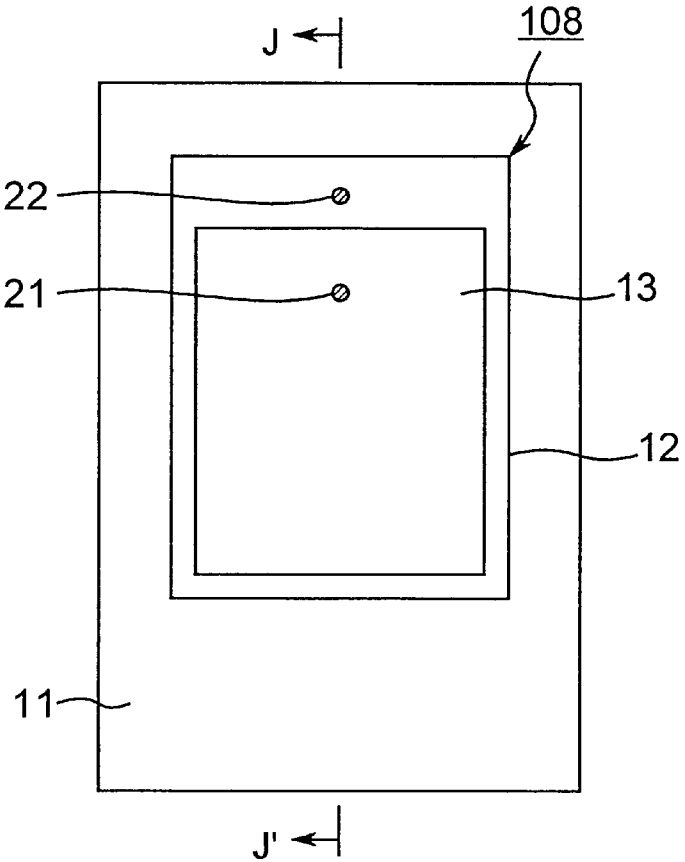
Figure 27B:
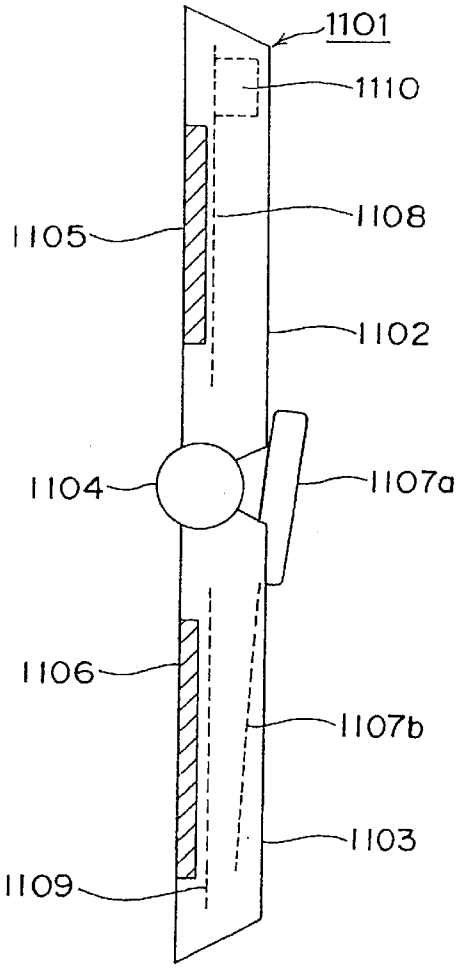
Figure 27B:
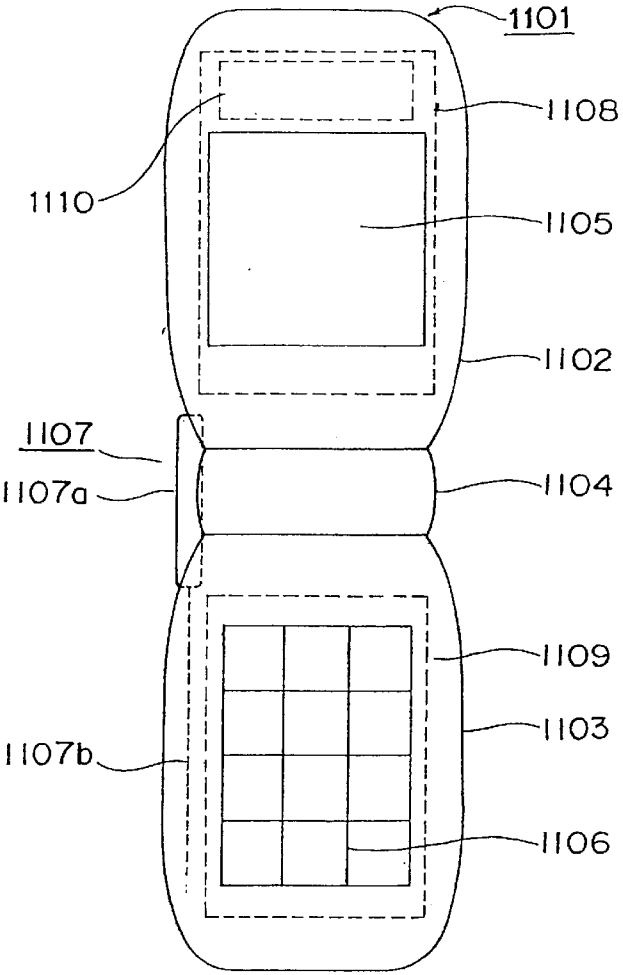
Figure 28B:
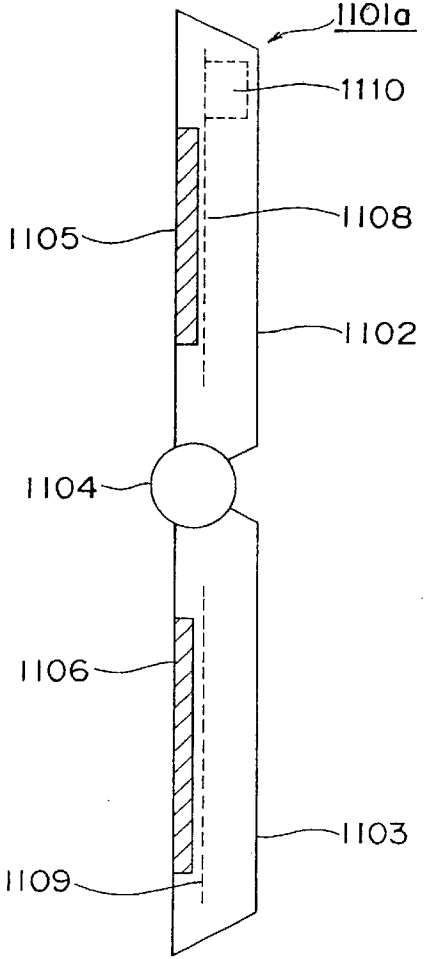
Figure 28A:
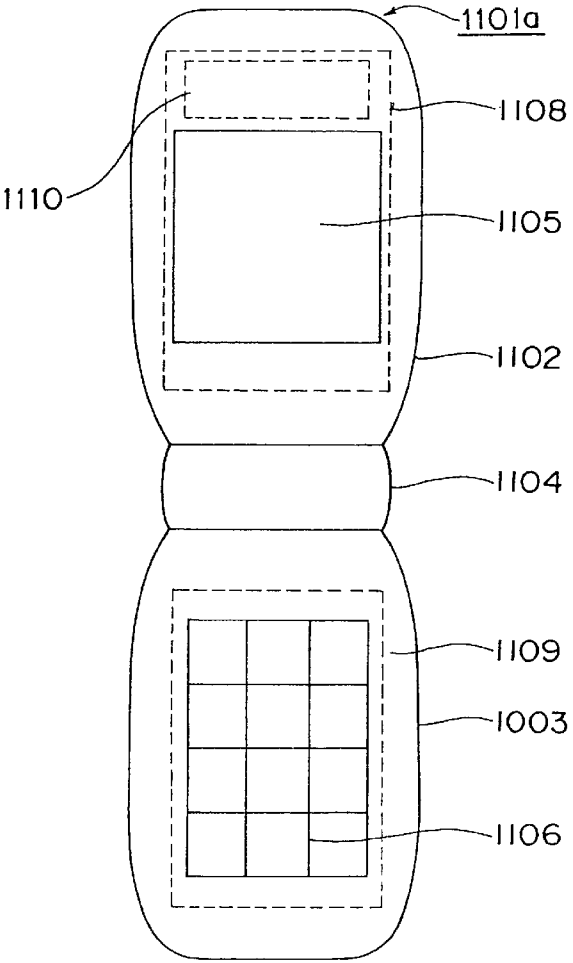
Figure 29B:
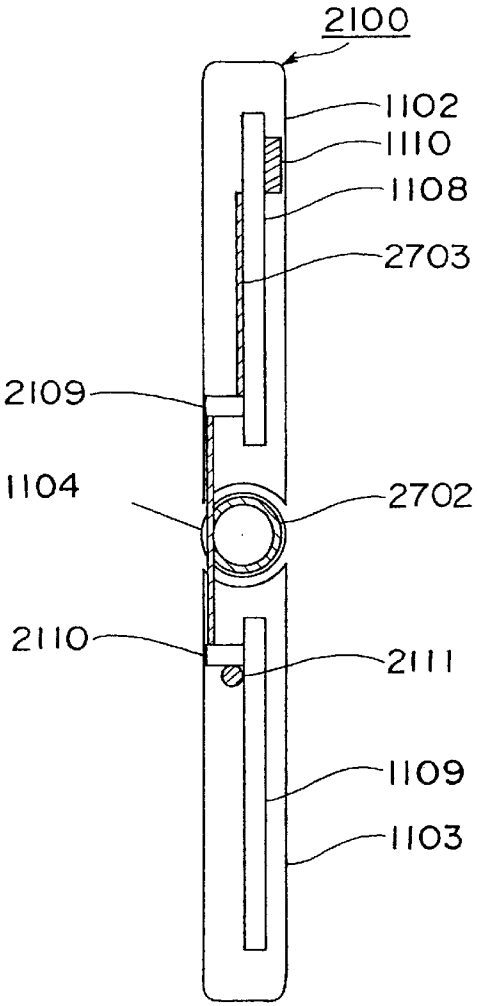
Figure 29A:
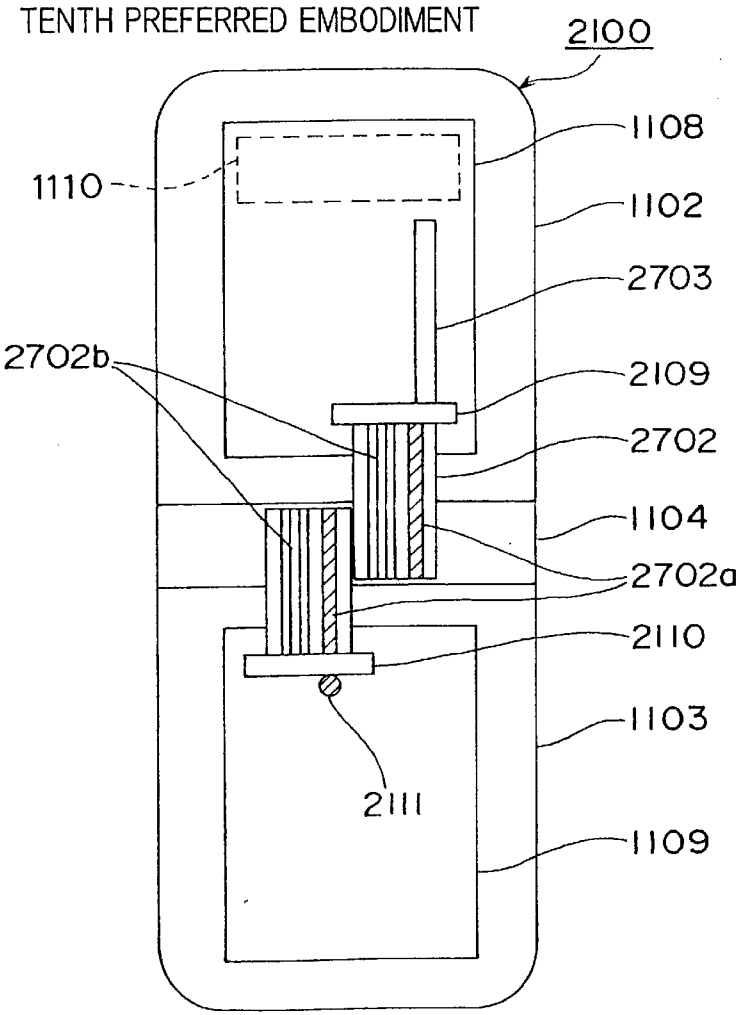
Figure 30A:
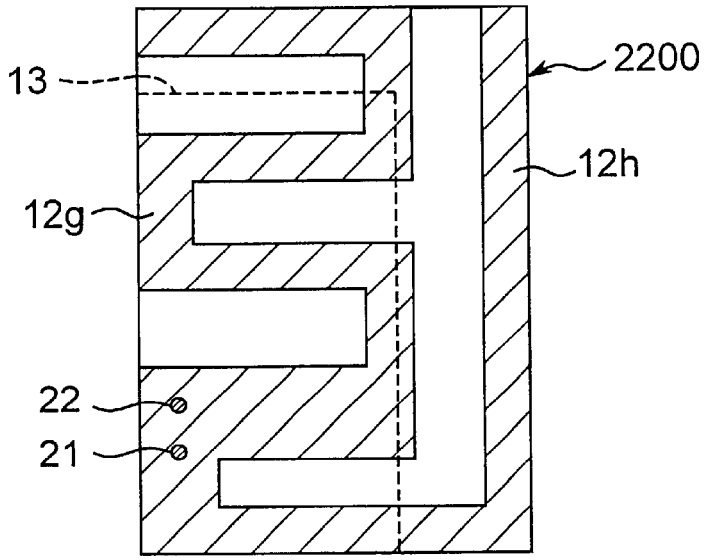
Figure 30B:
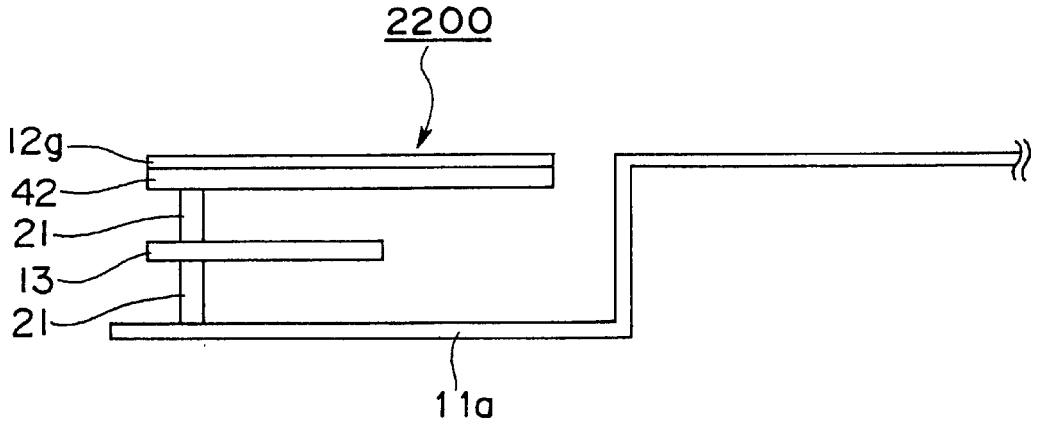
Figure 31B:
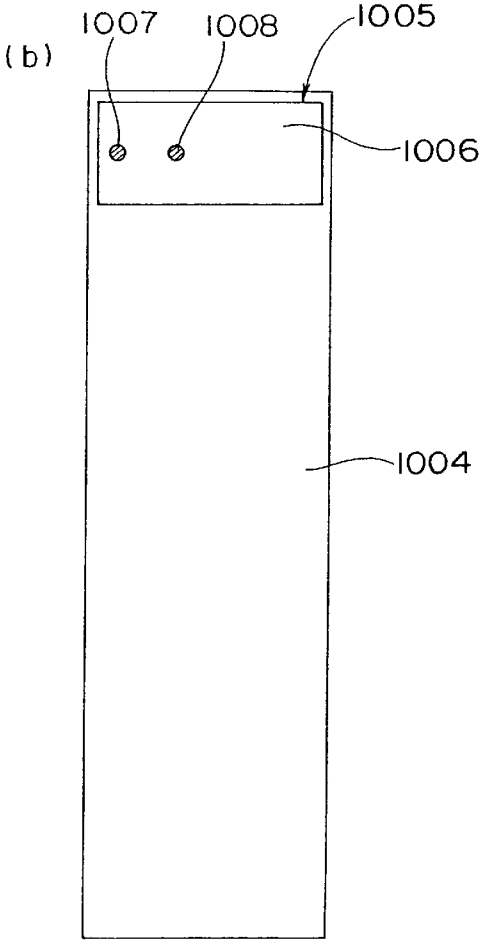
Fig.31B PRIOR ART
Figure 31A:
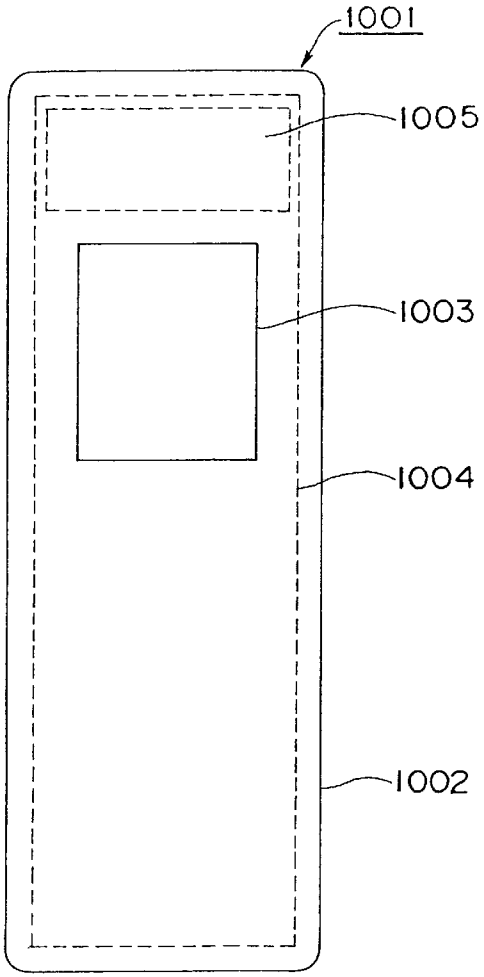
Fig.31A PRIOR ART

FIG. 11 is a longitudinal sectional view showing a construction of an inverted F-type antenna apparatus 103*c* according to a third modification modified of the third preferred embodiment of the present invention;

FIG. 12 is a longitudinal sectional view showing a construction of an inverted F-type antenna apparatus 103*d* according to a fourth modification of the third preferred embodiment of the present invention;

FIG. 13A is a plan view showing a construction of an inverted F-type antenna apparatus 104 according to a fourth preferred embodiment of the present invention;

FIG. 13B is a longitudinal sectional view taken along the line D–D' of FIG. 13A;

FIG. 14A is a plan view showing a construction of an inverted F-type antenna apparatus 105 according to a fifth preferred embodiment of the present invention;

FIG. 14B is a longitudinal sectional view taken along the line E–E' of FIG. 14A;

FIG. 15A is a plan view showing a construction of an inverted F-type antenna apparatus 105*a* according to a modification of the fifth preferred embodiment of the present invention;

FIG. 15B is a longitudinal sectional view taken along the line F–F' of FIG. 15A;

FIG. 16A is a plan view showing a construction of an inverted F-type antenna apparatus 106 according to a sixth preferred embodiment of the present invention;

FIG. 16B is a longitudinal sectional view taken along the line G–G' of FIG. 16A;

FIG. 17A is a plan view showing a construction of an inverted F-type antenna apparatus 106*a* according to a first modification of the sixth preferred embodiment of the present invention;

FIG. 17B is a longitudinal sectional view taken along the line H–H' of FIG. 17A;

FIG. 18 is a longitudinal sectional view showing a construction of an inverted F-type antenna apparatus 106*b* according to a second modification of the sixth preferred embodiment of the present invention;

FIG. 19 is a longitudinal sectional view showing a construction of an inverted F-type antenna apparatus 106*c* according to a third modification of the sixth preferred embodiment of the present invention;

FIG. 20A is a plan view showing a construction of an inverted F-type antenna apparatus 107 according to a seventh preferred embodiment of the present invention;

FIG. 20B is a plan view of an antenna element 12*e* of FIG. 20A;

FIG. 20C is a plan view of a coupling element 13*e* of FIG. 20A;

FIG. 20D is a plan view of a coupling element 14*e* of FIG. 20A;

FIG. 21 is a longitudinal sectional view taken along the line I–I' of FIG. 20A;

FIG. 22 is a Smith chart showing a frequency characteristic of the input impedance of the inverted F-type antenna apparatus 107 shown in FIGS. 20A and 21;

FIG. 23 is a graph showing a frequency characteristic of the voltage standing wave radio (VSWR) of the inverted F-type antenna apparatus 107 shown in FIGS. 20A and 21;

FIG. 24 is a plan view showing a construction of an antenna element 12*f* according to a first modification of the seventh preferred embodiment, or a modified preferred embodiment of the antenna element of the inverted F-type antenna apparatus 107 shown in FIGS. 20A and 21;

FIG. 25 is a plan view showing a construction of a coupling element 13*f* according to a second modification of the seventh preferred embodiment, or a modified preferred embodiment of the coupling element of the inverted F-type antenna apparatus 107 shown in FIGS. 20A and 21;

FIG. 26A is a plan view showing a construction of an inverted F-type antenna apparatus 108 according to an eighth preferred embodiment of the present invention;

FIG. 26B is a longitudinal sectional view taken along the line J–J' of FIG. 26A;

FIG. 27A is a plan view showing a construction of a portable radio communication apparatus 1101 according to a ninth preferred embodiment of the present invention;

FIG. 27B is a side view of FIG. 27A;

FIG. 28A is a plan view showing a construction of a portable radio communication apparatus 1101 a according to a modification of the ninth preferred embodiment of the present invention;

FIG. 28B is a side view of FIG. 28A;

FIG. 29A is a plan view showing a construction of a portable radio communication apparatus 2100 according to a tenth preferred embodiment of the present invention with part removed;

FIG. 29B is a side view of FIG. 29A;

FIG. 30A is a plan view showing a construction of a built-in antenna apparatus 2200 according to an eleventh preferred embodiment of the present invention;

FIG. 30B is a side view showing a construction of the built-in antenna apparatus 2200 of FIG. 30A;

FIG. 31A is a plan view showing a construction of a portable radio communication apparatus 1001 according to a prior art; and FIG. 31B is a plan view schematically showing a construction of a dielectric substrate 1004 provided with the inverted F-type antenna apparatus 1005 of FIG. 31A.

DETAILED DESCRIPTION OF THE PREFERRED EMBODIMENTS

Various preferred embodiments of the present invention will be described below with reference to the drawings. It is to be noted that the same components are denoted by the same reference numerals in the drawings, and no detailed description is provided therefor.

First Preferred Embodiment

Figure 1B:
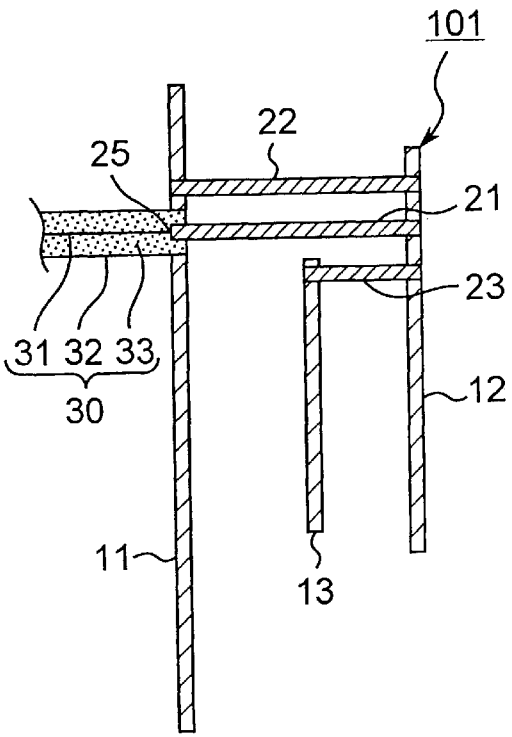
FIG. 1B is a longitudinal sectional view taken along the line A–A' of FIG. 1A.
Figure 1A:
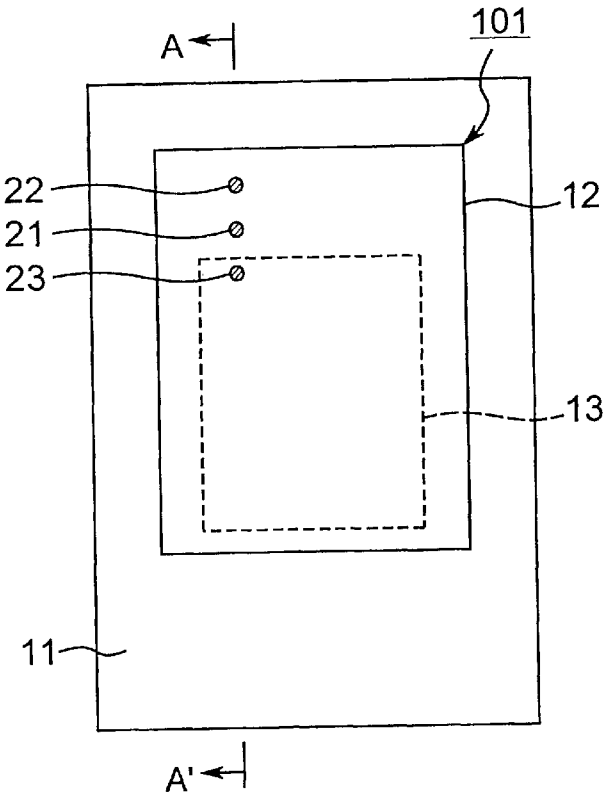
FIG. 1A is a plan view showing a construction of an inverted F-type antenna apparatus 101 according to a first preferred embodiment of the present invention.

FIG. 1A is a plan view showing a construction of an inverted F-type antenna apparatus 101 according to the first preferred embodiment of the present invention, and FIG. 1B is a longitudinal sectional view taken along the line A–A' of FIG. 1A. As shown in FIGS. 1A and 1B, the inverted F-type antenna apparatus 101 according to the present preferred embodiment is characterized in that a coupling element 13 is inserted between a grounding conductor 11 and an antenna element 12 which are arranged so as to be parallel to each other, and the coupling element 13 is electrically connected with the antenna element 12 via a connection conductor 23.

Referring to FIGS. 1A and 1B, the inverted F-type antenna apparatus 101 is provided with a rectangular plate-shaped grounding conductor 11 and a feeding point 25 provided in a predetermined portion of the grounding conductor 11, and further includes the antenna element 12 constructed of a rectangular plate-shaped conductor, a columnar pin-shaped short-circuit conductor 22, a columnar pin-shaped feeding conductor 21, a coupling element 13 constructed of a rectangular plate-shaped conductor and a columnar pin-shaped connection conductor 23.

The antenna element 12 is arranged while being supported by the connection conductor 23, the short-circuit conductor 22 and the feeding conductor 21 so as to become substantially parallel to the grounding conductor 11 and the coupling element 13, and the antenna element 12 is electrically connected with the grounding conductor 11 via the short-circuit conductor 22. One end of the feeding conductor 21 is electrically connected with the antenna element 12, and another end of the feeding conductor 21 is electrically connected with the feeding point 25 on the grounding conductor 11. Further, the coupling element 13 is arranged between the grounding conductor 11 and the antenna element 12 so as to become substantially parallel to the grounding conductor 11 and the antenna element 12, and the coupling element 13 is electrically connected with the antenna element 12 via the connection conductor 23. In this case, it is important that the connection conductor 23 is arranged in the vicinity of the short-circuit conductor 22 or the feeding conductor 21.

A feeding coaxial cable 30 is constructed of a central conductor 31 and a grounding conductor 32 wound around the central conductor 31 via a dielectric 33, and the feeding coaxial cable 30 is wired from a radio equipment (not shown) of a portable radio communication apparatus to the feeding point 25 of the inverted F-type antenna apparatus 101. Although a protective sheathing is formed around the grounding conductor 32 of the feeding coaxial cable 30, the sheathing is not shown in the drawings. At the feeding point 25, the central conductor 31 of the feeding coaxial cable 30 is connected with one end of the feeding conductor 21, while the grounding conductor 32 of the feeding coaxial cable 30 is connected with the grounding conductor 11.

The principle of operation of the inverted F-type antenna apparatus 101 of the present preferred embodiment will be described next. This inverted F-type antenna apparatus 101 has a structure such that the coupling element 13 is inserted between the grounding conductor 11 and the antenna element 12 in a PIFA portion constructed of the antenna element 12, the short-circuit conductor 22 and the feeding conductor 21, electrically connecting the antenna element 12 with the coupling element 13 via the connection conductor 23. It is important that the connection conductor 23 is arranged in the vicinity of a portion where an anti-node of the an current standing wave generated on the antenna element 12 is located when the inverted F-type antenna apparatus 101 is excited with a radio signal of a predetermined wavelength. In other words, it is important that one end of the connection conductor 23 is connected with the antenna element 12 in the vicinity of either the short-circuit conductor 22 or the feeding conductor 21. With this arrangement, the coupling element 13 has the anti-node of the current standing wave (maximum current point) in the vicinity of the connecting point to the connection conductor 23, and then, operates as a ¼ resonator where 1 denotes a wavelength of a frequency which is used in the antenna apparatus. In other words, it is preferable to set the lengths of the antenna element 12 and the coupling element 13 so as to operate in a manner as described above.

That is, the inverted F-type antenna apparatus 101 has the following first and second antenna apparatus each having a loop circuit:

(a) A first antenna apparatus having a first loop circuit whose length is a half-wave length, where the first loop circuit starts from the feeding point 25 via the feeding conductor 21, the connection conductor 23, the coupling element 13 to reach the terminal end portion (located on the lower side in FIG. 1B) of the coupling element 13 and further starts therefrom via the coupling element 13, the connection conductor 23, a part of the antenna element 12 and the short-circuit conductor 22 to the grounding conductor 11; and (b) A second antenna apparatus having a second loop circuit whose length is a half-wave length, where the second loop circuit starts from the feeding point 25 via the feeding conductor 21 and the antenna element 12 to reach the terminal end portion of the antenna element 12 (located on the lower side in FIG. 1B) and further starts therefrom via the antenna element 12 and the short-circuit conductor 22 to the grounding conductor 11.

Therefore, each of the antenna element 12 and the coupling element 13 preferably constitutes a quarter-wavelength resonator at the resonance frequencies of these two first and second antenna apparatuses.

The radio signal inputted via the feeding point 25 is mainly radiated from the antenna element 12 and the coupling element 13 via the feeding conductor 21. At this time, by providing a slight frequency difference between the resonance frequency of the first antenna apparatus and the resonance frequency of the second antenna apparatus, a wideband frequency characteristic can be obtained.

Figure 2A:
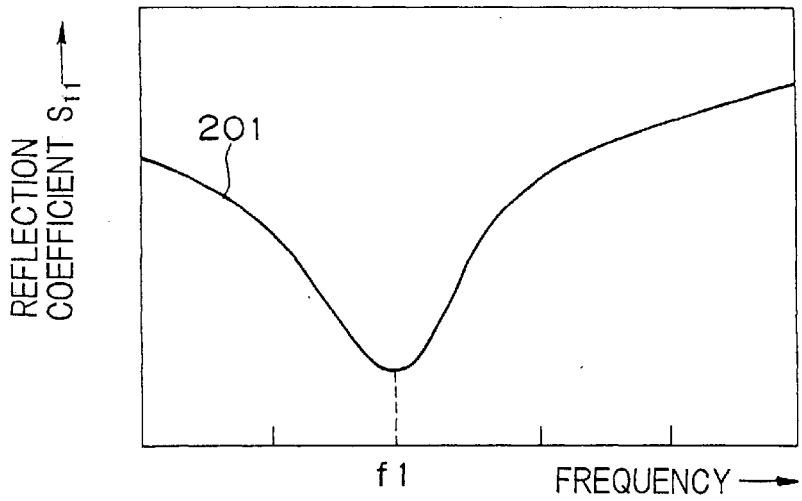
FIG. 2A is a graph showing a frequency characteristic of the reflection coefficient $S_{11}$ of a first antenna apparatus in the inverted F-type antenna apparatus 101 of FIGS. 1A and 1B.
Figure 2B:
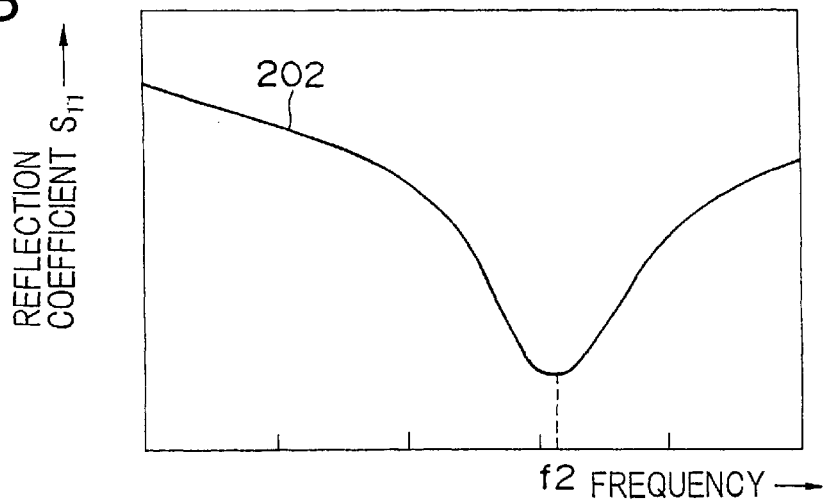
FIG. 2B is a graph showing a frequency characteristic of the reflection coefficient $S_{11}$ of a second antenna apparatus in the inverted F-type antenna apparatus 101 of FIGS. 1A and 1B.
Figure 2C:
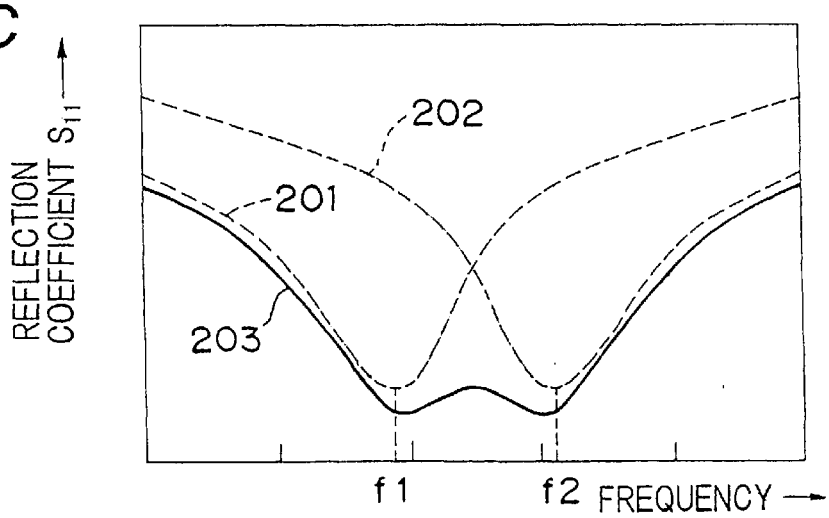
FIG. 2C is a graph showing a frequency characteristic of the reflection coefficient $S_{11}$ when the first and second antenna apparatuses are combined with each other in the inverted F-type antenna apparatus 101 of FIGS. 1A and 1B.

In the graph of FIG. 2A, the reference numeral 201 indicates a frequency characteristic curve of a reflection coefficient $S_{11}$ of the first antenna apparatus in the inverted F-type antenna apparatus 101 of FIGS. 1A and 1B. In the graph of FIG. 2B, the reference numeral 202 indicates a frequency characteristic curve of the reflection coefficient $S_{11}$ of the second antenna apparatus in the inverted F-type antenna apparatus 101 of FIGS. 1A and 1B. In the graph of FIG. 2C, the reference numeral 203 indicates a frequency characteristic curve of the reflection coefficient $S_{11}$ of the combination of the first and second antenna apparatuses in the inverted F-type antenna apparatus 101 of FIGS. 1A and 1B.

It is herein considered the case where the frequency characteristic of the first antenna apparatus including the coupling element 13 has a minimum amount of reflection loss at a resonance frequency f1 as indicated by 201 of FIG. 2A and the frequency characteristic of the second antenna apparatus including the antenna element 12 has a minimum amount of reflection loss at a resonance frequency f2 as indicated by 202 of FIG. 2B. In this case, by adjusting not only the areas of the antenna element 12 and the coupling element 13 but also the distances from the grounding conductor 11 to these elements 12 and 13 so that the resonance frequency f1 and the resonance frequency f2 are slightly different from each other, the frequency characteristic of the amount of reflection loss of the present antenna apparatus when being seen from the feeding point 25 has two peaks at the resonance frequency f1 and resonance frequency f2, as indicated by 203 of FIG. 2C. As a result, with regard to the frequency characteristic of the amount of reflection loss of the whole antenna apparatus, there can be obtained a very wideband frequency characteristic in comparison with the characteristic of each of the antenna apparatuses.

Although the coupling element 13 operates as a ¼ resonator according to the above description of the present preferred embodiment, the present invention is not limited to this. It is acceptable to operate the coupling element 13 as a resonator that has a resonance wavelength of any of odd multiples of ¼. It is also acceptable to operate the coupling element 13 as a resonator that has a resonance wavelength of any of even multiples of ¼. Most preferably, the coupling element 13 is operated as a ½ resonator. In this case, it is preferable to connect the connection conductor 23 with the antenna element 12 in a portion of a node (minimum current point) of the current distribution of the antenna element 12, i.e., at the open end thereof.

Furthermore, by filling a region surrounded by the grounding conductor 11 and the antenna element 12 partially or totally with a dielectric, namely, by filling the dielectric in a part of the internal portion or the whole portion of the region, the resonance frequency can be reduced, and the antenna apparatus is allowed to have a small size and a reduced weight with respect to an identical resonance frequency. Moreover, the shape of the antenna apparatus can be stably fixed, and therefore, characteristic variations in mass production can be suppressed.

In the aforementioned preferred embodiment, the feeding conductor 21, the short-circuit conductor 22 and the connection conductor 23 are fixedly supported by pressing and inserting respective end portions thereof into respective holes formed in the grounding conductor 11, the antenna element 12 and the coupling element 13 so that respective end portions thereof are electrically connected with the grounding conductor 11, the antenna element 12 and the coupling element 13, respectively. However, the present invention is not limited to this, and it is acceptable to fixedly support these conductors 21, 22 and 23 by soldering these conductors 21, 22 and 23 with the grounding conductor 11, the antenna element 12 and the coupling element 13. These modified preferred embodiments can be also applied to respective preferred embodiments which will be described later.

The feeding conductor 21, the short-circuit conductor 22 and the connection conductor 23 are formed so as to have a columnar pin-like shape in the above-mentioned preferred embodiment. However, the present invention is not limited to this, and it is acceptable to make them have a rectangular columnar pin-like shape, a rectangular plate-like shape, a strip plate-like shape or the like. These modified preferred embodiments can be also applied to respective preferred embodiments which will be described later.

Second Preferred Embodiment

Figure 3B:
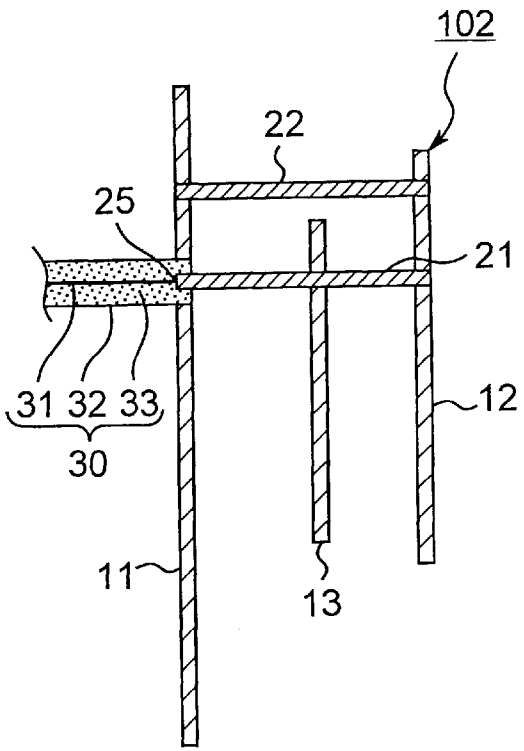
FIG. 3B is a longitudinal sectional view taken along the line B–B' of FIG. 3A.
Figure 3A:
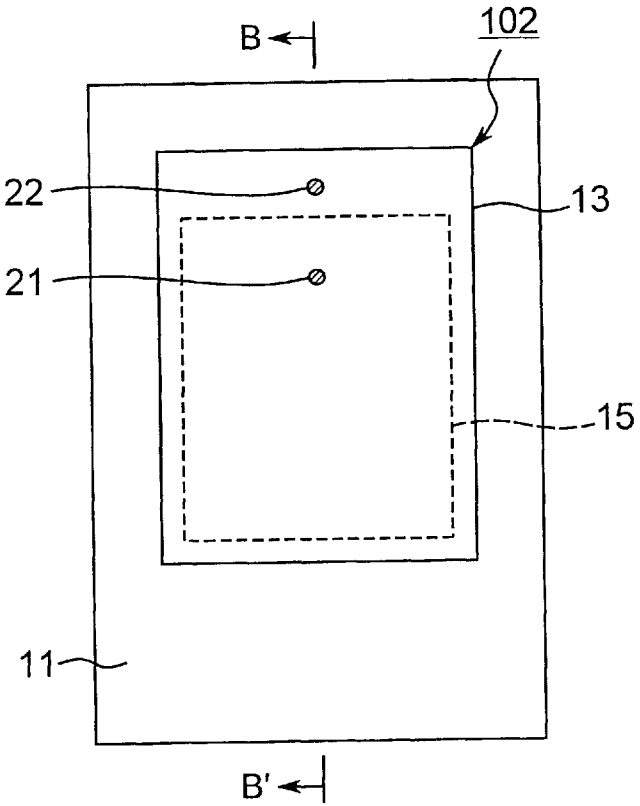
FIG. 3A is a plan view showing a construction of an inverted F-type antenna apparatus 102 according to a second preferred embodiment of the present invention.

FIG. 3A is a plan view showing a construction of an inverted F-type antenna apparatus 102 according to the second preferred embodiment of the present invention, and FIG. 3B is a longitudinal sectional view taken along the line B–B' of FIG. 3A. As shown in FIGS. 3A and 3B, the inverted F-type antenna apparatus 102 of the present preferred embodiment is provided with a grounding conductor 11 and a feeding point 25 and further includes an antenna element 12 constructed of a rectangular plate-shaped conductor, a short-circuit conductor 22, a feeding conductor 21 and a coupling element 13 made of a rectangular plate-shaped conductor.

Referring to FIGS. 3A and 3B, the antenna element 12 and the grounding conductor 11 are arranged so as to be substantially parallel to each other and to face each other, and the antenna element 12 is electrically connected with the grounding conductor 11 via the short-circuit conductor 22. One end of the feeding conductor 21 is electrically connected with the antenna element 12. Another end of the feeding conductor 21 is connected with the feeding coaxial cable 30 at the feeding point 25 on the grounding conductor 11, in a manner similar to that of the first preferred embodiment. Moreover, the coupling element 13 is inserted between the antenna element 12 and the grounding conductor 11 and electrically connected with the feeding conductor 21.

Also, in the inverted F-type antenna apparatus 102 of the present preferred embodiment constructed as above, by adjusting the areas of the antenna element 12 and the coupling element 13, the distance from the grounding conductor 11 to the antenna element 12 and/or the distance from the grounding conductor 11 to the coupling element 13 so as to make the resonance frequencies of the antenna apparatuses of the two loop circuits which are slightly different from each other, a wideband frequency characteristic can be obtained. Further, by making the feeding conductor 21 function as the connection conductor 23 of the first preferred embodiment, the antenna structure can be simplified and made suitable for mass production.

Modified Preferred Embodiments of Second Preferred Embodiment

Figure 4:
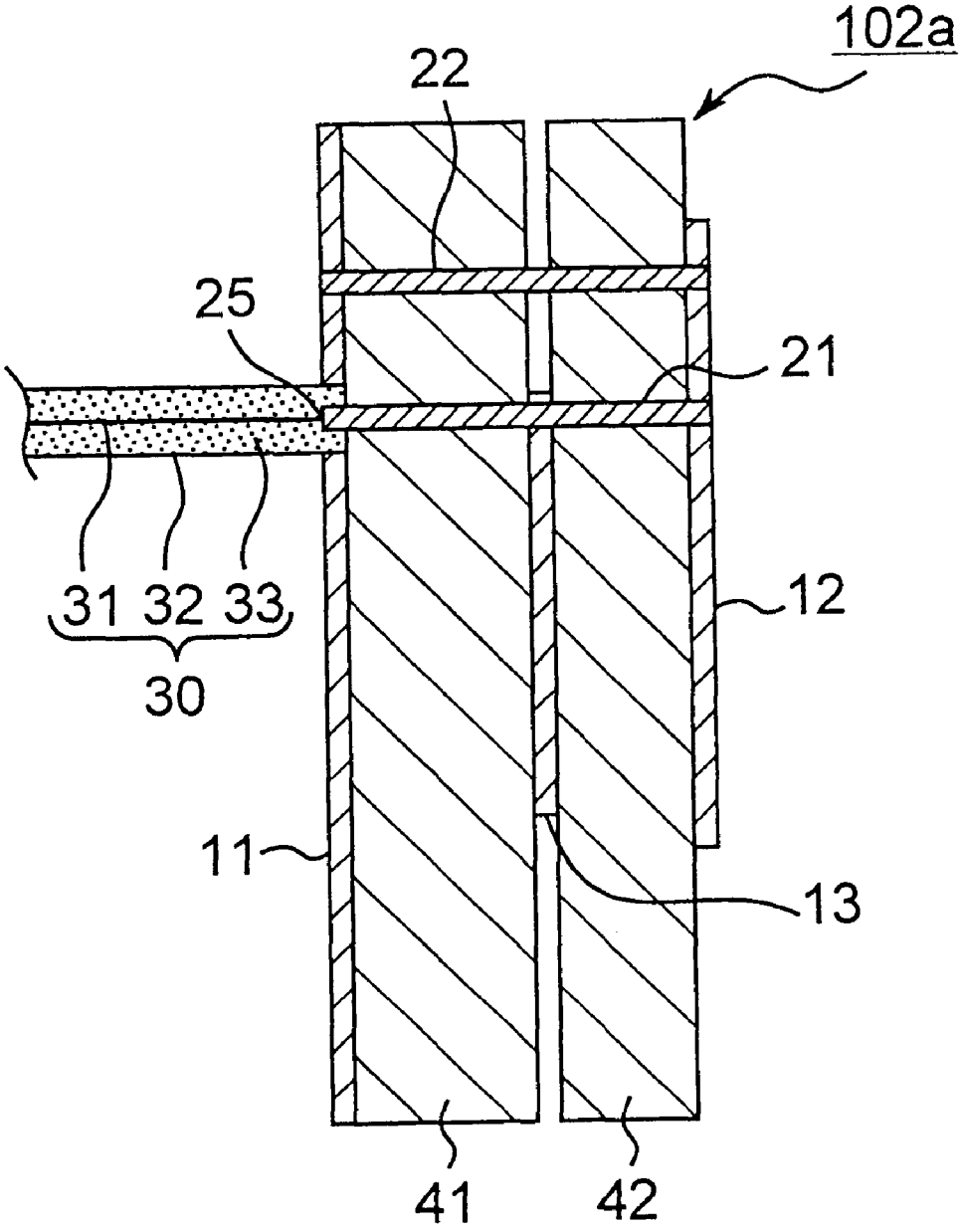
FIG. 4 is a longitudinal sectional view showing a construction of an inverted F-type antenna apparatus 102*a* according to a first modification of the second preferred embodiment of the present invention.

FIG. 4 is a longitudinal sectional view showing a construction of an inverted F-type antenna apparatus 102*a* according to the first modification of the second preferred embodiment of the present invention. In comparison with the inverted F-type antenna apparatus 102 of the second preferred embodiment, this inverted F-type antenna apparatus 102*a* is characterized by being constituted by a grounding conductor 11 and a coupling element 13 formed on two mutually different surfaces on a dielectric substrate 41 and an antenna element 12 formed on a dielectric substrate 42, and further, a feeding conductor 21 and a short-circuit conductor 22 are each made of a through hole conductor formed by filling a through hole, which penetrates the dielectric substrates 41 and 42 in the direction of thickness, with a metallic conductor. In this case, the coupling element 13 is electrically connected with the feeding conductor 21 but not electrically connected with the short-circuit conductor 22. It is to be noted that the coupling element 13 may be formed on the dielectric substrate 42. The inverted F-type antenna apparatus 102*a* constructed as above has operation and advantageous effects similar to those of the first and second preferred embodiments. By changing the thickness of each of the dielectric substrates 41 and 42, the distance between the grounding conductor 11 and the coupling element 13 and the distance between the coupling element 13 and the antenna element 12 can be changed, and the amount of electromagnetic field coupling between these elements can be adjusted.

Figure 5:
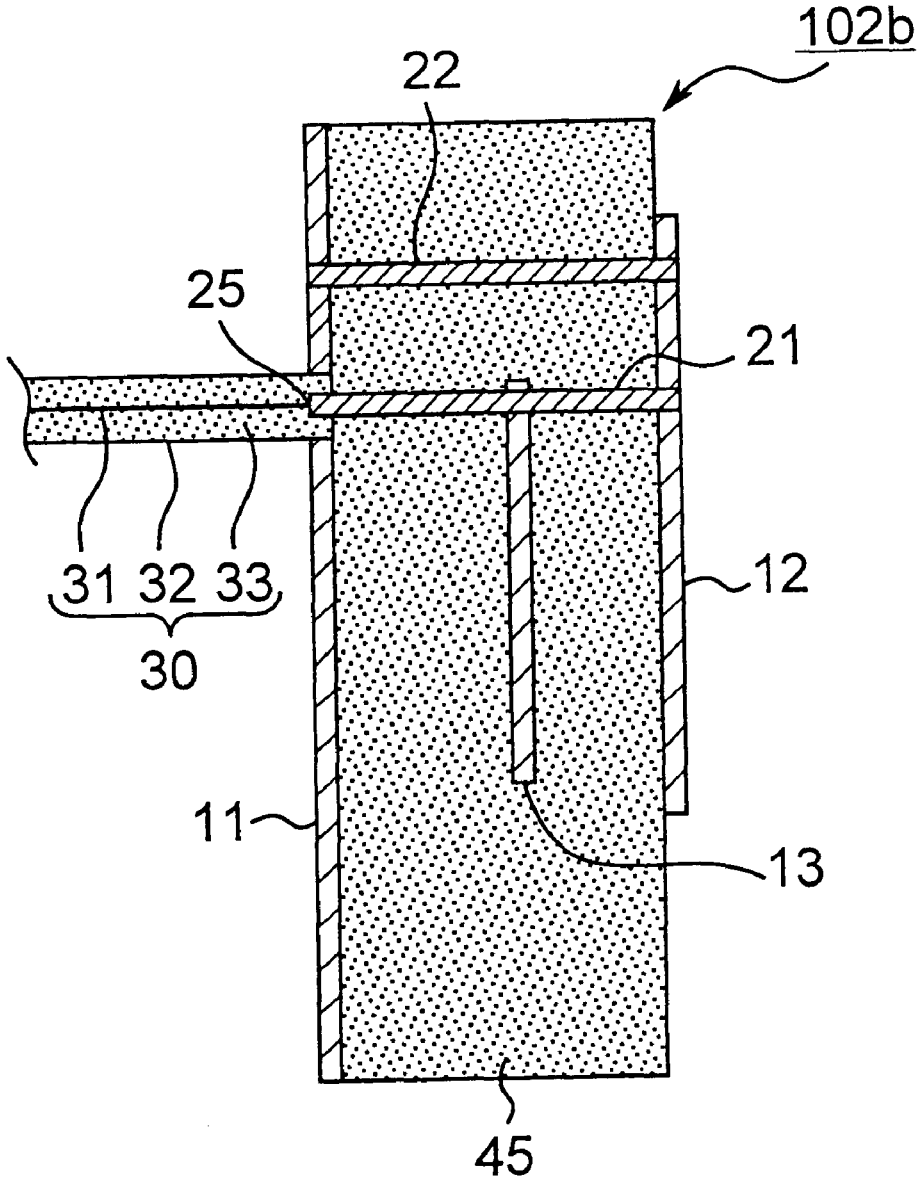
FIG. 5 is a longitudinal sectional view showing a construction of an inverted F-type antenna apparatus 102*b* according to a second modification of the second preferred embodiment of the present invention.

FIG. 5 is a longitudinal sectional view showing a construction of an inverted F-type antenna apparatus 102*b* according to the second modification of the second preferred embodiment of the present invention. In comparison with the inverted F-type antenna apparatus 102 of the second preferred embodiment, this inverted F-type antenna apparatus 102*b* can reliably fix and support the respective components of the inverted F-type antenna apparatus 102*b* by filling a space between the grounding conductor 11 and the antenna element 12 with a dielectric 45.

Figure 6:
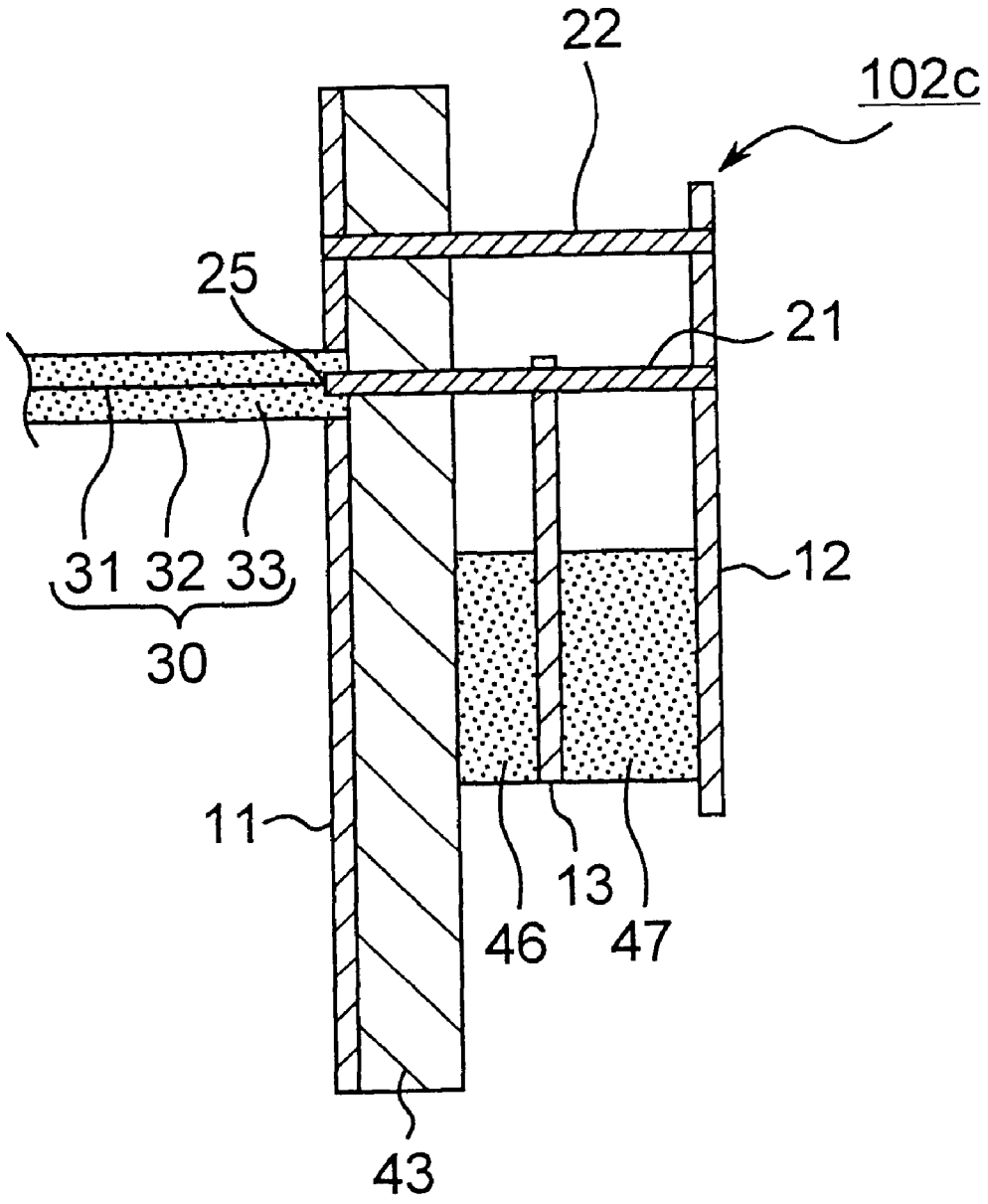
FIG. 6 is a longitudinal sectional view showing a construction of an inverted F-type antenna apparatus 102*c* according to a third modification of the second preferred embodiment of the present invention.

FIG. 6 is a longitudinal sectional view showing a construction of an inverted F-type antenna apparatus 102*c* according to the third modification of the second preferred embodiment of the present invention. In comparison with the inverted F-type antenna apparatus 102 of the second preferred embodiment, this inverted F-type antenna apparatus 102*c* is constructed of a grounding conductor 11 formed on a dielectric substrate 43. Further, by filling a space between a region of a part of the left-side flat surface of the coupling element 13 in the figure, and the dielectric substrate 43 with a dielectric 46, and also by filling a space between a region of a part of the right-side flat surface of the coupling element 13 in the figure, and the antenna element 12 with a dielectric 47, the respective components of the inverted F-type antenna apparatus 102*c* can be reliably fixed and supported.

Figure 7:
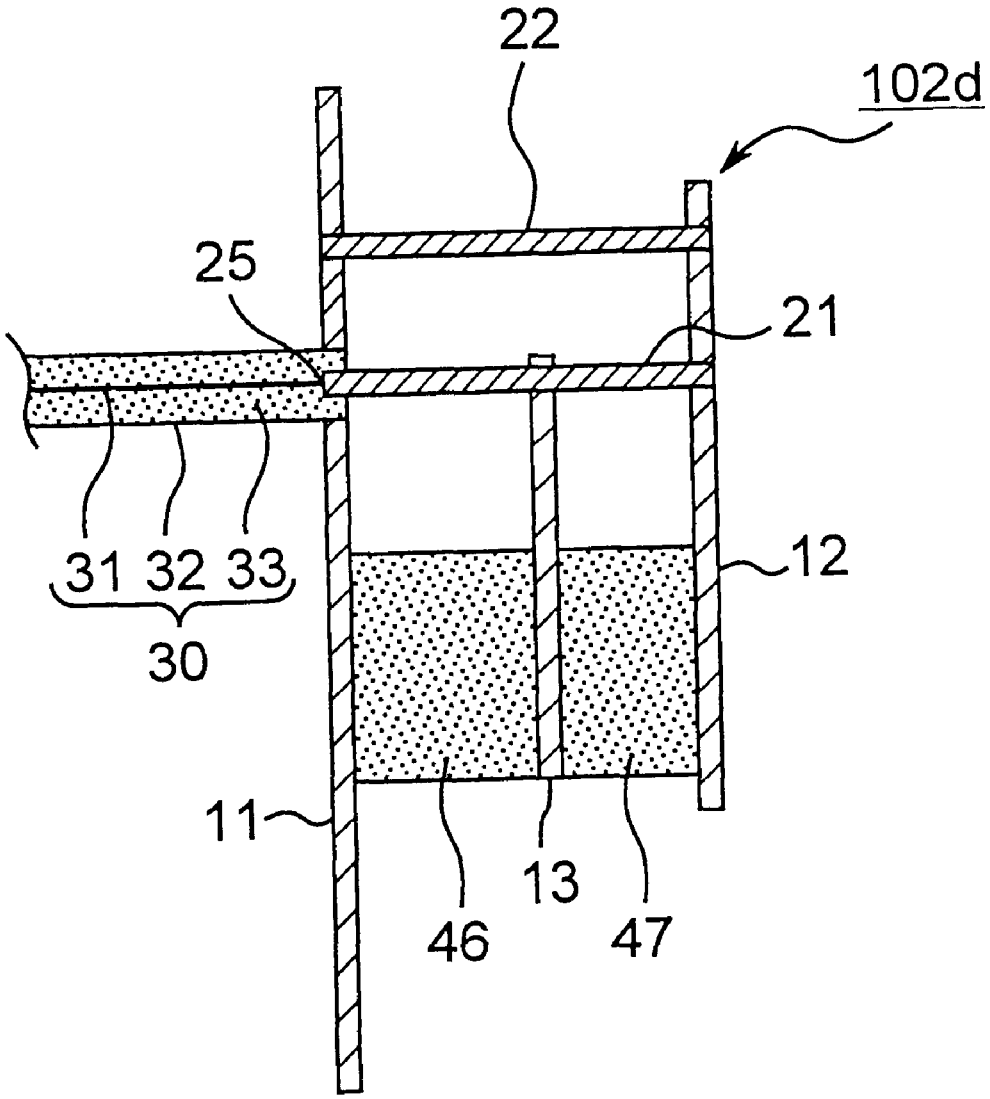
FIG. 7 is a longitudinal sectional view showing a construction of an inverted F-type antenna apparatus 102*d* according to a fourth modification of the second preferred embodiment of the present invention.

FIG. 7 is a longitudinal sectional view showing a construction of an inverted F-type antenna apparatus 102*d* according to the fourth modification of the second preferred embodiment of the present invention. In comparison with the inverted F-type antenna apparatus 102 of the second preferred embodiment, this inverted F-type antenna apparatus 102*d* can reliably fix and support the respective components of the inverted F-type antenna apparatus 102*d* by filling a space between a region of a part of the left-side flat surface of the coupling element 13 in the figure, and the grounding conductor 11 with a dielectric 46 and by filling a space between a region of a part of the right-side flat surface of the coupling element 13 in the figure, and the antenna element 12 with a dielectric 47.

Third Preferred Embodiment

Figure 8B:
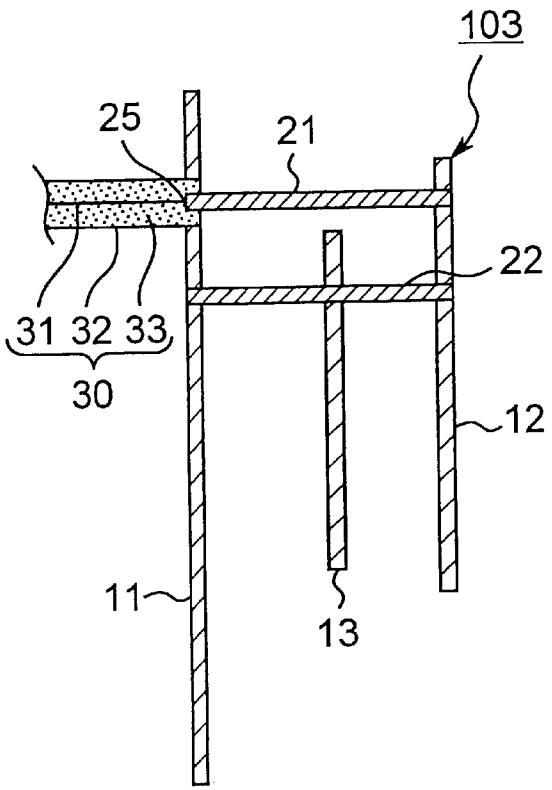
FIG. 8B is a longitudinal sectional view taken along the line C–C' of FIG. 8A.
Figure 8A:
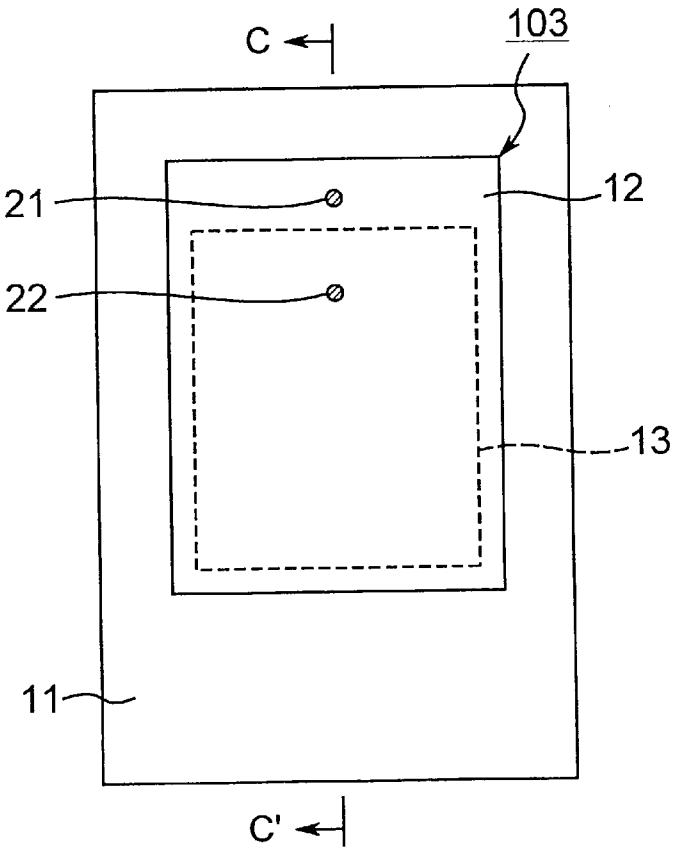
FIG. 8A is a plan view showing a construction of an inverted F-type antenna apparatus 103 according to a third preferred embodiment of the present invention.

FIG. 8A is a plan view showing a construction of an inverted F-type antenna apparatus 103 according to the third preferred embodiment of the present invention, and FIG. 8B is a longitudinal sectional view taken along the line C–C' of FIG. 8A. As shown in FIGS. 8A and 8B, the inverted F-type antenna apparatus 103 of the present preferred embodiment is provided with a grounding conductor 11 and a feeding point 25, and further includes an antenna element 12 constructed of a rectangular plate-shaped conductor, a short-circuit conductor 22, a feeding conductor 21 and a coupling element 13 constructed of a rectangular plate-shaped conductor. This antenna apparatus 103 is characterized in that the short-circuit conductor 22 is used as a connection conductor.

Referring to FIGS. 8A and 8B, the antenna element 12 and the grounding conductor 11 are arranged so as to be substantially parallel to each other and to face each other, and the antenna element 12 is electrically connected with the grounding conductor 11 via the short-circuit conductor 22. One end of the feeding conductor 21 is electrically connected with the antenna element 12, while another end of the feeding conductor 21 is connected with the feeding coaxial cable 30 at the feeding point 25 on the grounding conductor 11, in a manner similar to that of the first preferred embodiment. Moreover, the coupling element 13 is inserted between the antenna element 12 and the grounding conductor 11 and electrically connected with the short-circuit conductor 22.

Also, in the inverted F-type antenna apparatus 103 of the present preferred embodiment constructed as above, by adjusting the areas of the antenna element 12 and the coupling element 13, the distance from the grounding conductor 11 to the antenna element 12 and/or the distance from the grounding conductor 11 to the coupling element 13 so as to make the resonance frequencies of the antenna apparatuses of the two loop circuits which are slightly different from each other, a wideband frequency characteristic can be obtained. Further, by making the short-circuit conductor 22 function as the connection conductor 23 of the first preferred embodiment, the antenna structure can be simplified and made suitable for mass production.

Modified Preferred Embodiments of Third Preferred Embodiment

Figure 9:
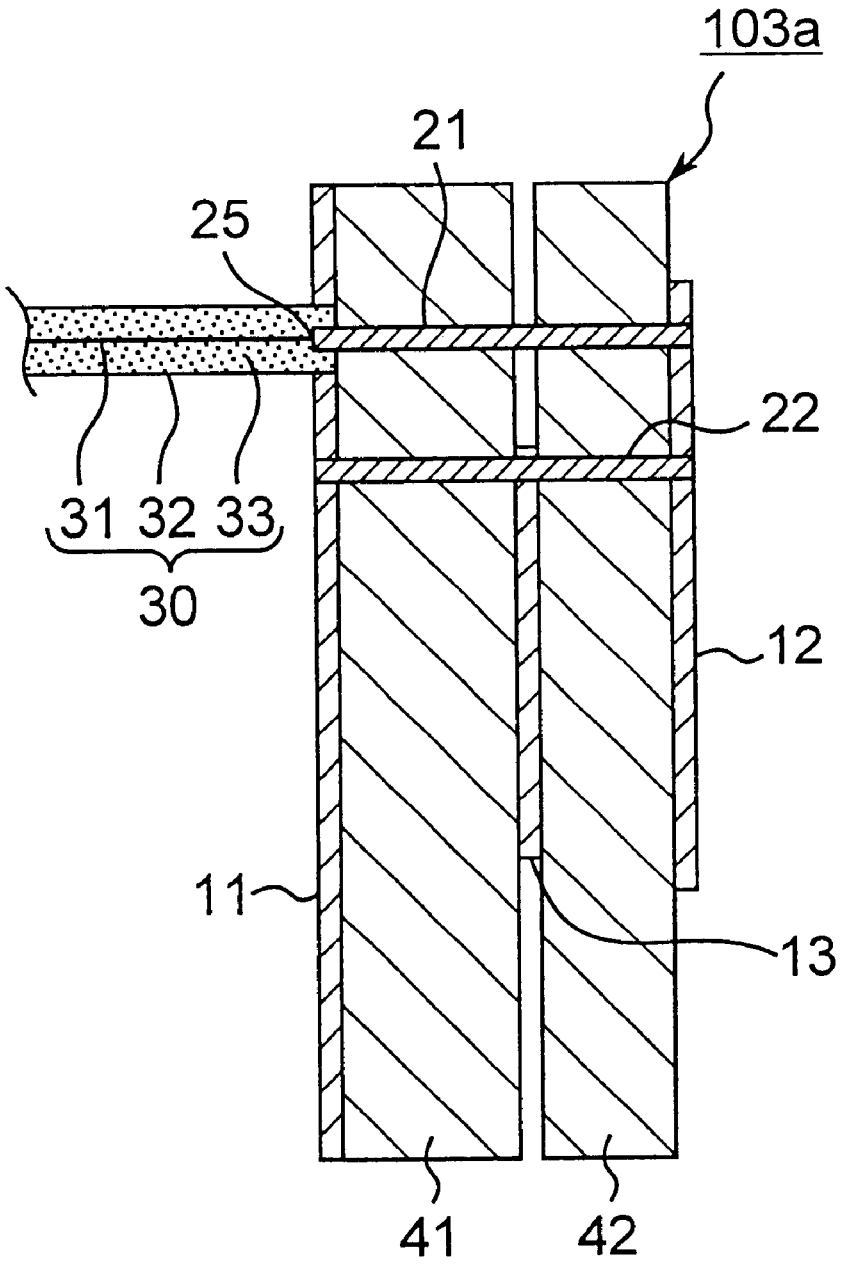
FIG. 9 is a longitudinal sectional view showing a construction of an inverted F-type antenna apparatus 103*a* according to a first modification of the third preferred embodiment of the present invention.

FIG. 9 is a longitudinal sectional view showing a construction of an inverted F-type antenna apparatus 103*a* according to the first modification of the third preferred embodiment of the present invention. In comparison with the inverted F-type antenna apparatus 103 of the third preferred embodiment, this inverted F-type antenna apparatus 103*a* is characterized in that the antenna apparatus 103 includes a grounding conductor 11 and a coupling element 13 formed on two different surfaces on a dielectric substrate 41 and an antenna element 12 formed on a dielectric substrate 42, and further, a feeding conductor 21 and a short-circuit conductor 22 are each constructed of a through hole conductor formed by filling a through hole, which penetrates the dielectric substrates 41 and 42 in the direction of thickness, with a metallic conductor. In this case, the coupling element 13 is electrically connected with the short-circuit conductor 22, but is not electrically connected with the feeding conductor 21. It is to be noted that the coupling element 13 may be formed on the dielectric substrate 42. The inverted F-type antenna apparatus 103*a* constructed as above has operation and advantageous effects similar to those of the first to third preferred embodiments. By changing the thickness of each of the dielectric substrates 41 and 42, the distance between the grounding conductor 11 and the coupling element 13 and the distance between the coupling element 13 and the antenna element 12 can be changed, and the amount of electromagnetic field coupling between these elements can be adjusted.

Figure 10:
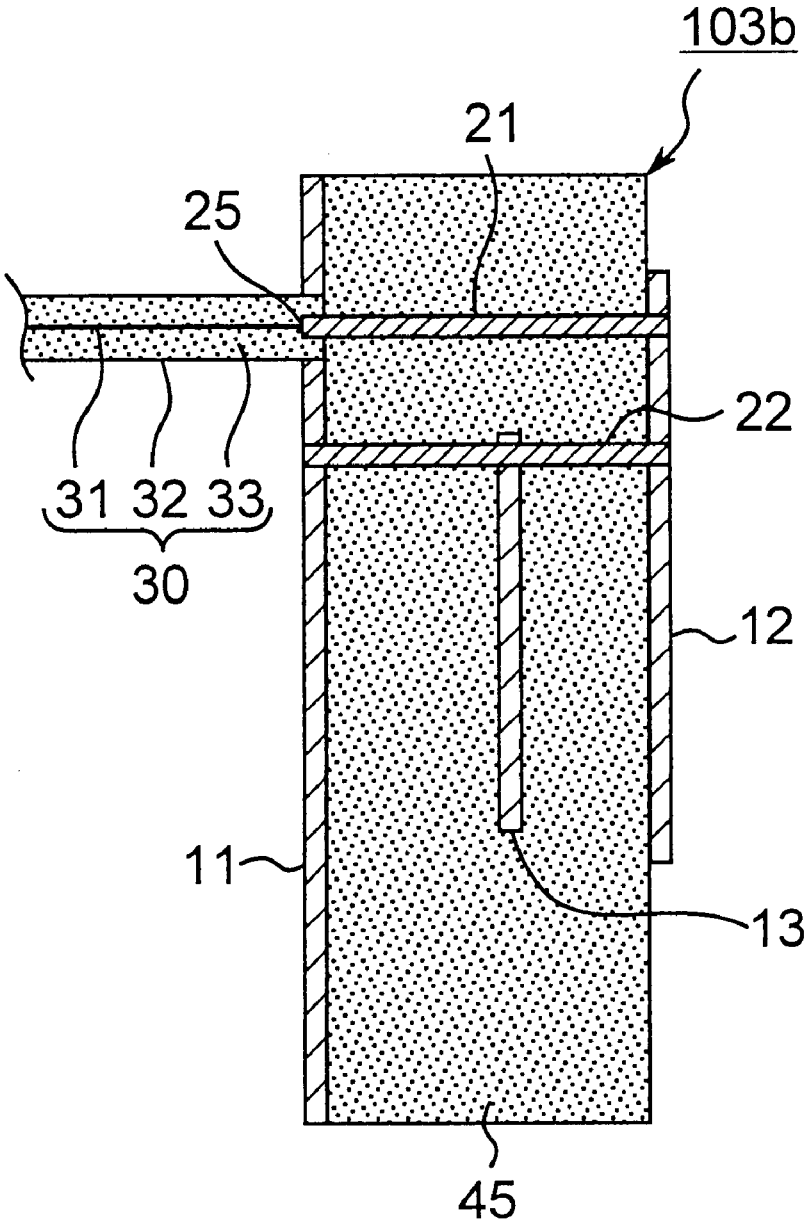
FIG. 10 is a longitudinal sectional view showing a construction of an inverted F-type antenna apparatus 103*b* according to a second modification of the third preferred embodiment of the present invention.

FIG. 10 is a longitudinal sectional view showing a construction of an inverted F-type antenna apparatus 103*b* according to the second modification of the third preferred embodiment of the present invention. In comparison with the inverted F-type antenna apparatus 103 of the third preferred embodiment, this inverted F-type antenna apparatus 103*b* can reliably fix and support the respective components of the inverted F-type antenna apparatus 103*b* by filling a space between the grounding conductor 11 and the antenna element 12 with a dielectric 45.

FIG. 11 is a longitudinal sectional view showing a construction of an inverted F-type antenna apparatus 103*c* according to the third modification of the third preferred embodiment of the present invention. In comparison with the inverted F-type antenna apparatus 103 of the third preferred embodiment, this inverted F-type antenna apparatus 103*c* is constituted by a grounding conductor 11 formed on a dielectric substrate 43, and is able to reliably fix and support the respective components of the inverted F-type antenna apparatus 103*c* by filling a space between a region of a part of the left-side flat surface of the coupling element 13 in the figure, and the dielectric substrate 43 with a dielectric 46, and by filling a space between a region of a part of the right-side flat surface of the coupling element 13 in the figure and the antenna element 12 with a dielectric 47.

FIG. 12 is a longitudinal sectional view showing a construction of an inverted F-type antenna apparatus 103*d* according to the fourth modification of the third preferred embodiment of the present invention. In comparison with the inverted F-type antenna apparatus 103 of the third preferred embodiment, this inverted F-type antenna apparatus 103*d* can reliably fix and support the respective components of the inverted F-type antenna apparatus 103*d* by filling a space between a region of a part of the left-side flat surface of the coupling element 13 in the figure, and the grounding conductor 11 with a dielectric 46, and also by filling a space between a region of a part of the right-side flat surface of the coupling element 13 in the figure and the antenna element 12 with a dielectric 47.

Fourth Preferred Embodiment

FIG. 13A is a plan view showing a construction of an inverted F-type antenna apparatus 104 according to the fourth preferred embodiment of the present invention, and FIG. 13B is a longitudinal sectional view taken along the line D–D' of FIG. 13A. In comparison with the inverted F-type antenna apparatus 103 of the second preferred embodiment shown in FIGS. 3A and 3B, this inverted F-type antenna apparatus 104, as shown in FIGS. 13A and 13B, is characterized in that a further coupling element 14 is inserted between the coupling element 13 and the grounding conductor 11. In this case, the coupling element 14 is electrically connected with the feeding conductor 21, but is not electrically connected with the short-circuit conductor 22.

In the inverted F-type antenna apparatus 104 constructed as above, by adjusting not only the areas of the antenna element 12 and the coupling elements 13 and 14 but also the respective distances from the grounding conductor 11 to the coupling elements 13 and 14 or the antenna element 12 so as to make the resonance frequencies of the plurality of antenna apparatuses of a plurality of loop circuits be slightly different from each other, a wideband characteristic can be obtained. Moreover, it is enabled to perform impedance matching between the antenna apparatus 104 and the feeding coaxial cable 30 so as to cover a plurality of frequency bands by means of the plurality of coupling elements 13 and 14. Furthermore, it is acceptable to fill a space between the grounding conductor 11 and the antenna element 12 partially or totally with a dielectric, namely, to fill the dielectric in a part of the internal portion or the whole portion of the space, or to arrange a dielectric substrate, in a manner similar to those of the first to fourth modification of the second preferred embodiment. In this case, the advantageous effect of reducing the resonance frequency can be expected, and characteristic variations in mass production can be suppressed by stably fixing the shape of the antenna apparatus.

Fifth Preferred Embodiment

FIG. 14A is a plan view showing a construction of an inverted F-type antenna apparatus 105 according to the fifth preferred embodiment of the present invention, and FIG. 14B is a longitudinal sectional view taken along the line E–E' of FIG. 14A. In comparison with the inverted F-type antenna apparatus 102 of the second preferred embodiment, this inverted F-type antenna apparatus 105, as shown in FIGS. 14A and 14B, is characterized by including an antenna element 12*a* whose lower portion in the figure is formed in a meandering configuration with a plurality of slits 12*s* arranged parallel to the shorter side direction and a coupling element 13*a* whose lower portion in the figure is formed in a meandering configuration with a plurality of slits 13*s* arranged parallel to the shorter side direction.

In the inverted F-type antenna apparatus 105 constructed as above, by forming the plurality of slits 12*s* and 13*s* in the antenna element 12*a* and the feeding element 13*a,* respectively, there can be obtained such advantageous effects as reducing the resonance frequencies and increasing the reactance component by virtue of their increased path lengths and the advantageous effect of increasing the reactance component by virtue of the reduced amount of coupling accompanied by their reduction in area. Taking advantage of these effects, in addition to the fact that impedance matching between the antenna apparatus 105 and the feeding coaxial cable 30 and the adjustment of the resonance frequency of the antenna apparatus 105 can be easily done, the reduction in the resonance frequency of the antenna apparatus 105 can be achieved to allow the antenna apparatus 105 to have a small size and a reduced weight. That is, when the capacitive coupling between the antenna element 12*a* and the coupling element 13*a* and the capacitive coupling between the coupling element 13*a* and the grounding conductor 11 are comparatively large, by adjusting the areas of the slits 12*s* and 13*s* so that the opposing area therebetween is reduced with the path length maintained constant, the capacitive coupling between these elements can be reduced to allow impedance matching to be achieved. Further, by adjusting not only the distance between the antenna element 12*a* and the coupling element 13*a* but also the distance between the coupling element 13*a* and the grounding conductor 11, the adjustment of impedance matching can easily be performed.

In the aforementioned preferred embodiment, the structural example in which both the antenna element 12*a* and the coupling element 13*a* are provided with the slits 12*s* and 13*s* has been described. However, the present invention is not limited to this, and at least one of the antenna element 12*a* and the coupling element 13 a may be provided with the slits 12*s* and 13*s*. Moreover, by providing at least one of the antenna element 12*a* and the coupling element 13*a* with a slot and by adjusting the amount of electromagnetic field coupling between the antenna element 12*a* and the coupling element 13*a* and the amount of electromagnetic field coupling between the coupling element 13*a* and the grounding conductor 11, the adjustment of impedance matching between the input impedance of the antenna apparatus 105 and the feeding coaxial cable 30 can be easily done. Moreover, by providing at least one of the antenna element 12*a* and the coupling element 13*a* with a slot, the resonance frequency of the antenna element can be adjusted.

Although the aforementioned preferred embodiment is provided with one coupling element 13*a,* the present invention is not limited to this. By inserting and arranging two or more coupling elements 13*a* between the antenna element 12*a* and the grounding conductor 11, a frequency characteristic of a wider band can be achieved. In this case, by using a plurality of coupling elements 13*a,* impedance matching can be achieved so as to cover a plurality of frequency bands.

Moreover, by forming a slit in the grounding conductor 11 and by adjusting the amount of electromagnetic field coupling between the grounding conductor 11 and the antenna element 12*a,* operation and advantageous effects similar to those above can be obtained. Furthermore, in the aforementioned preferred embodiment, the structural example in which the feeding conductor 21 is made to function as a connection conductor is described. However, the present invention is not limited to this, and it is acceptable to use the short-circuit conductor 22 as a connection conductor or to provide a further connection conductor for connecting the coupling element 13*a* with the antenna element 12*a*. Furthermore, the space surrounded by the grounding conductor 11 and the antenna element 12*a* may be filled partially or totally with a dielectric, namely the dielectric may be filled in a part of the internal portion or the whole portion of the space. In this case, the advantageous effect of reducing the resonance frequency can be obtained, and the shape of the antenna apparatus can be stably fixed. Therefore, electrical characteristic variations in mass production can be suppressed.

Modified Preferred Embodiment of Fifth Preferred Embodiment

FIG. 15A is a plan view showing a construction of an inverted F-type antenna apparatus 105*a* according to the modification of the fifth preferred embodiment of the present invention, and FIG. 15B is a longitudinal sectional view taken along the line F–F' of FIG. 15A. In comparison with the inverted F-type antenna apparatus 105 of the fifth preferred embodiment, this inverted F-type antenna apparatus 105*a,* as shown in FIGS. 15A and 15B, is characterized in that a plurality of slits 12*s* formed in the antenna element 12*b* and a plurality of slits 13*s* formed in the coupling element 13*b* face each other, respectively. In the inverted F-type antenna apparatus 105*a* constructed as above, directions 901 and 902 of the currents that flow on the antenna element 12*b* as shown in FIG. 15A can be made to coincide with directions 911 and 912, respectively, of the currents that flow on the coupling element 13*b*. By aligning these directions of the currents, the radiation efficiency of the inverted F-type antenna apparatus 105*a* can be improved, and the antenna gain can be improved.

Sixth Preferred Embodiment

FIG. 16A is a plan view showing a construction of an inverted F-type antenna apparatus 106 according to the sixth preferred embodiment of the present invention, and FIG. 16B is a longitudinal sectional view taken along the line G–G' of FIG. 16A. In comparison with the inverted F-type antenna apparatus 102 shown in FIGS. 3A and 3B, this inverted F-type antenna apparatus 106, as shown in FIGS. 16A and 16B, is constructed in such a manner that the coupling element 13*c* is perpendicularly bent in two portions parallel to the shorter side direction thereof, and the coupling element 13*c* is constructed of the following:

(i) a portion 13*ca* parallel to the grounding conductor 11 and the antenna element 12;

(ii) a portion 13*cb* perpendicular to the grounding conductor 11 and the antenna element 12; and (iii) a portion 13*cc* parallel to the grounding conductor 11 and the antenna element 12.

In this case, it is set such that a distance between the portion 13*cc* and the antenna element 12 becomes shorter than a distance between the portion 13*ca* and the antenna element 12 and the amount of electromagnetic field coupling between the antenna element 12 and the coupling element 13*c* is increased.

That is, the coupling element 13*c* has one portion bent and has a step-shaped configuration with a difference in level. With this arrangement, the distance between the grounding conductor 11 and the coupling element 13*c* and the distance between the antenna element 12 and the coupling element 13*c* are changed depending on the positions of these elements in the longitudinal direction. Consequently, the distance is changed between the portion 13*ca* located on the side where the antenna element 12 and the grounding conductor 11 are electrically connected with each other (short-circuit conductor 22 side) and the portion 13*cc* located on the opposite open end side. With this arrangement, the distance between the antenna element 12 and the coupling element 13*c* and the distance between the grounding conductor 11 and the coupling element 13*c* can be changed depending on the positions of these elements in the longitudinal direction, and this enables the adjustment of the amount of electromagnetic field coupling between the coupling element 13*c* and the antenna element 12 and the amount of electromagnetic field coupling between the coupling element 13*c* and the grounding conductor 11. Therefore, frequency adjustment in the manufacturing stage can be easily done, and this leads to suitability for mass production. Moreover, the electrical length of the coupling element 13*c* can be made longer than that of the planar structure by bending the coupling element 13*c* with three-dimensional deformation. Therefore, the resonance frequency of the antenna apparatus 106 can be reduced to allow the antenna apparatus 106 to have a small size and a reduced weight.

In the present preferred embodiment, by bending a part of the coupling element 13*c* as shown in FIG. 16B to put the coupling element 13 closer to the open end and its neighborhood of the antenna element 12, the amount of electromagnetic field coupling between the coupling element 13*c* and the antenna element 12 can be increased, and the resonance frequency of the antenna apparatus can be further reduced. Moreover, by increasing the distance between the coupling element 13*c* and the grounding conductor 11 at the end portion of the inverted F-type antenna apparatus 106 as shown in FIG. 16B, electromagnetic field coupling with components of a transceiver or the like arranged in the vicinity of the antenna apparatus 106 can be reduced, enabling the prevention of malfunction of the transceiver or the like.

Modified Preferred Embodiments of Sixth Preferred Embodiment

FIG. 17A is a plan view showing a construction of an inverted F-type antenna apparatus 106*a* according to the first modification of the sixth preferred embodiment of the present invention, and FIG. 17B is a longitudinal sectional view taken along the line H–H' of FIG. 17A. In comparison with the inverted F-type antenna apparatus 106 of the sixth preferred embodiment shown in FIG. 16B, this inverted F-type antenna apparatus 106*a* is constructed in such a manner that the coupling element 13 is not bent, and the antenna element 12*c* is perpendicularly bent in two portions parallel to the shorter side direction thereof. The antenna element 12*c* is constructed of the following:

(i) a portion 12*ca* parallel to the grounding conductor 11 and the coupling element 13;

(ii) a portion 12*cb* perpendicular to the grounding conductor 11 and the coupling element 13; and (iii) a portion 12*cc* parallel to the grounding conductor 11 and the coupling element 13.

It is set such that a distance between the portion 12*cc* and the coupling element 13 becomes shorter than a distance between the portion 12*ca* and the coupling element 13, and the amount of electromagnetic field coupling between the antenna element 12*c* and the coupling element 13*c* is increased. The inverted F-type antenna apparatus 106*a* of the first modification of the sixth preferred embodiment constructed as above has operation and advantageous effects similar to those of the inverted F-type antenna apparatus 106 of the sixth preferred embodiment.

FIG. 18 is a longitudinal sectional view showing a construction of an inverted F-type antenna apparatus 106*b* according to the second modification of the sixth preferred embodiment of the present invention.

Referring to FIG. 18, a liquid crystal display section 41 is arranged on the top surface side in the center portion in the longitudinal direction of an upper housing 40 of a folding type portable radio communication apparatus. A dielectric substrate 43 is arranged on the rear side of this liquid crystal display section 41, and a grounding conductor 11 is formed on a flat surface of the dielectric substrate 43, which is located on the liquid crystal display section 41 side. An inverted F-type antenna apparatus 106*b* having the following construction is provided on the upper side of this dielectric substrate 43. This inverted F-type antenna apparatus 106*b* is basically provided with the grounding conductor 11 and a feeding point 25 in a manner similar to that of the structure of the inverted F-type antenna apparatus 102 of the second preferred embodiment shown in FIG. 3B, and further includes an antenna element 12*d* constructed of a rectangular plate-shaped conductor, a short-circuit conductor 22, a feeding conductor 21 and a coupling element 13 constructed of a rectangular plate-shaped conductor. In this case, the antenna element 12*d* is characterized by being bent in a curved shape along the housing configuration of the upper housing 40. With this arrangement, there is such a unique advantageous effect that the inverted F-type antenna apparatus 106*b* can be compactly accommodated in the upper housing 40.

FIG. 19 is a longitudinal sectional view showing a construction of an inverted F-type antenna apparatus 106*c* according to the third modification of the sixth preferred embodiment of the present invention.

Referring to FIG. 19, a liquid crystal display section 41 is arranged on the top surface side in the center portion in the longitudinal direction of the upper housing 40 of a folding type portable radio communication apparatus. A grounding conductor 11*a* constructed of, for example, a rectangular metal plate, is arranged on the rear side of this liquid crystal display section 41 while being bent along the configuration of the liquid crystal display section 41. An inverted F-type antenna apparatus 106*c* having the following construction is provided on the upper side of the upper housing 40 with this grounding conductor 11*a*. This inverted F-type antenna apparatus 106*c* is basically provided with a grounding conductor a 11 and a feeding point 25 in a manner similar to that of the structure of the inverted F-type antenna apparatus 102 of the second preferred embodiment shown in FIG. 3B, and further includes an antenna element 12*d* constructed of a rectangular plate-shaped conductor, a short-circuit conductor 22, a feeding conductor 21 and a coupling element 13 constructed of a rectangular plate-shaped conductor. In this case, the antenna element 12*d* is characterized by being bent in a curved shape along the housing configuration of the upper housing 40. With this arrangement, there is such a unique advantageous effect that the inverted F-type antenna apparatus 106*c* can be compactly accommodated in the upper housing 40.

In the sixth preferred embodiment and the modified preferred embodiments described above, by arranging at least either the antenna elements 12, 12*c* and 12*d* or the coupling elements 13 and 13*c* so as to be inclined from the grounding conductor 11, the amount of electromagnetic field coupling between the antenna elements 12, 12*c* and 12*d* and the coupling elements 13 and 13*c*, and the amount of electromagnetic field coupling between the coupling elements 13 and 13*c* and the connection conductors 11 and 11*a* can be adjusted. Also, in this case, impedance matching and resonance frequency adjustment can be performed.

Although the sixth preferred embodiment and the modified preferred embodiments thereof are provided with one coupling element 13 or 13*c*, the present invention is not limited to this. By providing two or more coupling elements 13 and 13*c*, a frequency characteristic of a wider band can be achieved. In this case, by employing a plurality of coupling elements 13 and 13*c*, impedance matching can be performed so as to cover a plurality of frequency bands.

In the sixth preferred embodiment and the modified preferred embodiments thereof, it is acceptable to form a slit or slot in at least any one of the antenna elements 12, 12*c* and 12*d*, the coupling elements 13 and 13*c* and the grounding conductors 11 and 11*a*. In this case, operation and advantageous effects similar to those described above can be obtained. Moreover, although the feeding conductor 21 has such a function as the connection conductor in the sixth preferred embodiment and the modified preferred embodiments thereof as described above, it is acceptable to provide the short-circuit conductor 21 having the function of the connection conductor or to provide a further connection conductor in place of this.

Furthermore, in a manner similar to those of the various modified preferred embodiments of the second preferred embodiment shown in FIGS. 4 to 7, the space surrounded by the grounding conductor 11 and one of the antenna elements 12, 12*c* and 12*d* may be filled partially or totally with a dielectric, namely, the dielectric may be filled in a part of the internal portion or the whole portion of the space. In this case, the advantageous effect of reducing the resonance frequency of the antenna apparatus can be obtained, and the respective components of the antenna apparatus can be stably fixed. Therefore, electrical characteristic variations in mass production can be suppressed.

Seventh Preferred Embodiment

FIG. 20A is a plan view showing a construction of an inverted F-type antenna apparatus 107 according to the seventh preferred embodiment of the present invention, FIG. 20B is a plan view of an antenna element 12*e* of FIG. 20A, FIG. 20C is a plan view of a coupling element 13*e* of FIG. 20A, and FIG. 20D is a plan view of a coupling element 14*e* of FIG. 20A. FIG. 21 is a longitudinal sectional view taken along the line I–I' of FIG. 20A. This inverted F-type antenna apparatus 107 is related to an implemental example produced for a trial purpose by the present inventor and others. In these FIGS. 20A to 20D, the dimensions of the respective components are shown using a unit of millimeters.

Referring to FIGS. 20A to 20D and FIG. 21, there is provided an the inverted F-type antenna apparatus 107, which has a feeding point 25 on a grounding conductor 11 having a length of 70 mm and a width of 43 mm. This inverted F-type antenna apparatus 107 further includes the following:

(i) the antenna element 12*e* having a length of 17 mm and a width of 43 mm shown in FIG. 20B;

(ii) the coupling element 13*e* shown in FIG. 20C;

(iii) the coupling element 14*e* shown in FIG. 20D;

(iv) a short-circuit conductor 22 for electrically connecting the antenna element 12*e* with the grounding conductor 11; and (v) a feeding conductor 21 for electrically connecting the central conductor 31 of the feeding coaxial cable 30 with the antenna element 12*e* via two coupling elements 13*e* and 14*e*.

In this case, an L-figured strip-shaped slit 12*es* is formed in the antenna element 12*e*, and a linear type strip-shaped slit 13*es* is formed in the coupling element 13*e*. The element length and the amount of electromagnetic field coupling of the antenna apparatus are changed by adjusting the lengths and areas of these slits 12*es* and 13*es*, and impedance matching between the input impedance of the antenna apparatus and the characteristic impedance of the feeding coaxial cable 30 can be easily adjusted.

Moreover, as shown in FIG. 21, the antenna element 12*e* is arranged to be inclined from the grounding conductor 11 so that the height thereof from the grounding conductor 11 located on the feeding conductor 21 side becomes 9.2 mm and the height thereof from the grounding conductor 11 located on the open-end side becomes 7.9 mm. Likewise, the coupling elements 13*e* and 14*e* are also arranged so as to be inclined from the grounding conductor 11. In the coupling elements 13*e* and 14*e,* their heights from the grounding conductor 11 located on the feeding conductor 21 side are 8.1 mm and 6.6 mm, respectively, and their heights from the grounding conductor 11 located on the open end side are 6.7 mm and 4.7 mm, respectively. By changing the distance from each of the antenna element 12*e* and the coupling elements 13*e* and 14*e* to the grounding conductor 11 according to their positions in the longitudinal direction, the amount of electromagnetic field coupling between the antenna element 12*e,* each of the coupling elements 13*e* and 14*e* and the grounding conductor 11 can be adjusted. In addition to the fact that the resonance frequency of the antenna apparatus 107 can be adjusted so as to be reduced, impedance matching between the antenna apparatus 107 and the feeding coaxial cable 30 can be easily adjusted, and this leads to achievement of a frequency characteristic of a wider band.

In the aforementioned seventh preferred embodiment, one end of the feeding conductor 21 is electrically connected with the antenna element 12*e,* and another end of the feeding conductor 21 is electrically connected with the central conductor 31 of the feeding coaxial cable 30 via the feeding point 25 on the grounding conductor 11. It is important that the coupling elements 13*e* and 14*e* are each electrically connected with the feeding conductor 21, however, is not electrically connected with the short-circuit conductor 22. That is, the diameter of the short-circuit conductor 22 is smaller than the through holes 13*eh* and 14*eh* formed through the coupling elements 13*e* and 14*e,* respectively, and the short-circuit conductor 22 passes through the center portions of these through holes 13*eh* and 14*eh*. Therefore, the short-circuit conductor 22 is not electrically connected with the coupling elements 13*e* and 14*e*.

FIG. 22 is a Smith chart showing a frequency characteristic of the input impedance of the inverted F-type antenna apparatus 107 shown in FIGS. 20A and 21, and FIG. 23 is a graph showing a frequency characteristic of the voltage standing wave ratio (VSWR) of the inverted F-type antenna apparatus 107 shown in FIGS. 20A and 21.

As is apparent from FIG. 22, it can be understood that a plurality of resonance circles exist and the antenna apparatus is in a state of multiple resonance. Referring to FIG. 23, a frequency range, in which VSWR was equal to or smaller than three, ranged from 905 to 1024 MHz, and the ratio of the range to the band was 12.3%. In other words, a wideband frequency characteristic was able to be obtained.

In the aforementioned preferred embodiment, even when a dimension obtained by adding the shorter side to the longer side of the grounding conductor 11 has an extremely small value which is equal to or smaller than a quarter of the wavelength, a wideband characteristic can be achieved. Moreover, the impedance characteristic of the antenna apparatus 107 can be easily adjusted. Therefore, this arrangement is suitable for constituting an antenna apparatus on the grounding conductor 11 that has comparatively small dimensions with respect to the wavelength in a portable radio communication apparatus such as a folding type portable telephone.

In the above-mentioned preferred embodiment, the space surrounded by the grounding conductor 11 and the antenna element 12*e* may be filled partially or totally with a dielectric, namely, the electric may be filled in a part of the internal portion or the whole portion of the space. In this case, the advantageous effect of reducing the resonance frequency of the antenna apparatus can be obtained, and the shape of the antenna apparatus can be stably fixed. Therefore, variations in mass production can be suppressed.

Modified Preferred Embodiments of Seventh Preferred Embodiment

FIG. 24 is a plan view showing a construction of an antenna element 12*f* according to the first modification of the seventh preferred embodiment, or a modified preferred embodiment of the antenna element of the inverted F-type antenna apparatus 107 shown in FIGS. 20A and 21. As shown in FIG. 24, the antenna element 12*f* is formed so as to have a slot 12*ss* of a predetermined shape. The antenna element 12*f* is constructed of a rectangular ring-shaped conductor portion 12*fa,* a rectangular patch-shaped conductor portion 12*fc* and a strip-shaped conductor portion 12*fb* for coupling the conductor portion 12*fa* and the conductor portion 12*fc* with each other. The antenna element 12*f* of the above-mentioned configuration has such a unique advantageous effect that it is able to have a long substantial element length and have an increased amount of electromagnetic field coupling with other conductors. Moreover, by forming the slot 12*ss* in the antenna element 12*f,* the resonance frequency of the antenna apparatus can be adjusted.

FIG. 25 is a plan view showing a construction of a coupling element 13*f* according to the second modified preferred embodiment of the seventh preferred embodiment, or a modified preferred embodiment of the coupling element of the inverted F-type antenna apparatus 107 shown in FIGS. 20A and 21. As shown in FIG. 25, the coupling element 13*f* is formed so as to have a slot 13*ss* of a predetermined shape. The coupling element 13*f* is constructed of a rectangular ring-shaped conductor portion 13*fa,* a rectangular patch-shaped conductor portion 13*fc* and a strip-shaped conductor portion 13*fb* for coupling these conductor portions 13*fa* and the conductor portion 13*fc* to each other. The coupling element 13*f* of the above-mentioned configuration has such a unique advantageous effect that it is able to have a long substantial element length and have an increased amount of electromagnetic field coupling with other conductors. Moreover, by forming the slot 13*ss* in the coupling element 13*f,* the resonance frequency of the antenna apparatus can be adjusted.

Eighth Preferred Embodiment

FIG. 26A is a plan view showing a construction of an inverted F-type antenna apparatus 108 according to the eighth preferred embodiment of the present invention, and FIG. 26B is a longitudinal sectional view taken along the line J–J' of FIG. 26A. In comparison with the inverted F-type antenna apparatus 102 of the second preferred embodiment shown in FIGS. 3A and 3B, this inverted F-type antenna apparatus 108 is characterized in that the antenna element 12 is inserted between the grounding conductor 11 and the coupling element 13, and the other construction is similar to that of the second preferred embodiment. One end of the feeding conductor 21 is electrically connected with the coupling element 13 and electrically connected with the antenna element 12 roughly in the center portion of the feeding conductor 21. Another end of the feeding conductor 21 is connected with the central conductor 31 of the feeding coaxial cable 30. Moreover, one end of the short-circuit conductor 22 is connected with the antenna element 12, and another end thereof is electrically connected with the grounding conductor 11.

The inverted F-type antenna apparatus 108 according to the eighth preferred embodiment constructed as above has operation and advantageous effects similar to those of the inverted F-type antenna apparatus 102 of the second preferred embodiment. Moreover, also in this inverted F-type antenna apparatus 108, the space between the coupling element 13 and the grounding conductor 11 may be filled partially or totally with a dielectric, as described in connection with the modified preferred embodiments of the second preferred embodiment. In this case, the advantageous effect of reducing the resonance frequency of the antenna apparatus and the advantageous effect of restraining variations in mass production can be obtained.

Ninth Preferred Embodiment

FIG. 27A is a plan view showing a construction of a portable radio communication apparatus 1101 according to the ninth preferred embodiment of the present invention, and FIG. 27B is a side view of FIG. 27A.

Referring to FIGS. 27A and 27B, a portable radio communication apparatus 1101 is a structural example of a folding type portable telephone and is constructed of an upper housing 1102, a lower housing 1103 and a hinge portion 1104 that is a mechanical section for coupling the upper housing 1102 with the lower housing 1103 and making the upper and lower housings 1102 and 1103 be superimposed on each other when the hinge portion 1104 is folded. In this case, a liquid crystal display section 1105 is provided roughly in the center portion of the upper housing 1102, and an upper dielectric substrate 1108 is arranged on the lower side in the thickness direction, and a built-in antenna 1110 is provided in the upper portion in the figure of the dielectric substrate 1108 where a transmitting signal is supplied from a feeding section of a radio transmitter (not shown) to the built-in antenna 1110. Moreover, a ten-key section 1106 is provided roughly in the center portion of the lower housing 1103, and a lower dielectric substrate 1109 is arranged on the lower side in the thickness direction. A whip antenna 1107 constructed of a helical antenna 1107*a* and a monopole antenna 1107*b* is provided on the lower housing 1103 retractably along the longitudinal direction of the lower housing 1103 on the left side in FIG. 27A and then, a transmitting signal is fed from a feeding section of a radio transmitter (not shown) to the whip antenna 1107.

In the present preferred embodiment, the built-in antenna 1110 can be constructed of any one of the aforementioned first to eighth preferred embodiments or their modified preferred embodiments. In this case, the built-in antenna 1110 and the whip antenna 1107 can be controlled so that at least one of these two antennas is used by a space diversity technology during transmission and reception of a radio signal.

In the portable radio communication apparatus 1101 constructed as above, the built-in antenna 1110 can achieve a wideband characteristic even when the dimension of the grounding conductor formed on the rear surface of the upper dielectric substrate 1108 is equal to or smaller than a quarter of the wavelength. Therefore, satisfactory communication quality can be obtained. Moreover, by arranging the built-in antenna 1110 in the upper portion of the inside of the upper housing 1102, it is enabled to make the antenna apparatus less susceptible to the influence of the human body, such as fingers of the user, during a telephone conversation. With this arrangement, the radiation loss of the radio wave from the portable radio communication apparatus 1101 can be reduced, and the antenna gain of the built-in antenna 1110 can be improved.

In the aforementioned preferred embodiment, the whip antenna 1107 is provided on the lower housing 1103. However, the present invention is not limited to this, and the whip antenna may be provided on the upper housing 1102. Moreover, the built-in antenna 1110 may be arranged in the lower portion of the upper housing 1102 or in the lower portion of the lower housing 1103.

Modified Preferred Embodiment of Ninth Preferred Embodiment

FIG. 28A is a plan view showing a construction of a portable radio communication apparatus 1101*a* according to the modification of the ninth preferred embodiment of the present invention, and FIG. 28B is a side view of FIG. 28A.

Referring to FIGS. 28A and 28B, this portable radio communication apparatus 1101*a* is characterized in that the whip antenna 1107 on the lower housing 1103 is removed in comparison with the portable radio communication apparatus 1101 of the ninth preferred embodiment.

Tenth Preferred Embodiment

FIG. 29A is a plan view showing a construction of a portable radio communication apparatus 2100 according to the tenth preferred embodiment of the present invention with part removed, and FIG. 29B is a side view of FIG. 29A. In these FIGS. 29A and 29B, the same components as those of FIGS. 28A and 28B are denoted by same reference numerals.

Referring to FIGS. 29A and 29B, the built-in antenna 1110 formed on the dielectric substrate 1108 of the upper housing 1102 is provided, and a flexible dielectric substrate 2702 on which conductor patterns 2702*a* and 2702*b* are formed is provided in a hinge portion 1104. One end of each of the conductor patterns 2702*a* and 2702*b* is connected with a connector 2109 formed on the upper dielectric substrate 1108, while another end of each of the conductor patterns 2702*a* and 2702*b* is connected with a connector 2110 formed on the lower dielectric substrate 1109.

In this case, a strip-shaped conductor pattern 2703 formed on the upper dielectric substrate 1108 is connected with the conductor pattern 2702*a* via a connector 2109. The conductor pattern 2702*a* is further connected with a feeding point 2111 via a connector 2110. One monopole antenna is constructed of a conductor pattern extended from this conductor pattern 2703 to the feeding point 2111. Then, the monopole antenna and the built-in antenna 1110 can be controlled so that at least one of these two antennas is used by the space diversity technology during transmission and reception of a radio signal.

Eleventh Preferred Embodiment

FIG. 30A is a plan view showing a construction of a built-in antenna apparatus 2200 according to the eleventh preferred embodiment of the present invention, and FIG. 30B is a side view showing a construction of a built-in antenna apparatus 2200 of FIG. 30A.

The built-in antenna 2200 of this eleventh preferred embodiment is employed in place of the aforementioned built-in antenna 1110, and is provided with a bent grounding conductor 11*a*, an antenna element 12*g* (operating in a manner similar to that of the aforementioned antenna element 12 or the like) formed in a meandering configuration on a dielectric substrate 42, and a strip-shaped antenna element 12*h* that is formed while being connected with the antenna 12*g* on the dielectric substrate 42 and operates as a monopole antenna. The built-in antenna 2200 further includes a coupling element 13 arranged while being inserted between the antenna element 12*g* and the grounding conductor 11*a,* a feeding conductor 21 for connecting a feeding point with the antenna element 12*g,* and a connection conductor 22 for connecting the antenna element 12*g* with the coupling element 13. In this case, the feeding conductor 21 is electrically connected with the coupling element 13 and the antenna element 12*g,* while the short-circuit conductor 22 is electrically connected with the antenna element 12*g* in a state in which the short-circuit conductor 22 is not connected with the coupling conductor 13. Then, by making the resonance frequency of the antenna element 12*g* provided with the coupling element 13 be different from the resonance frequency of the antenna element 12*h,* the antenna apparatus can be used as a wideband built-in antenna apparatus 2200, which can cover a plurality of frequency bands.

In the preferred embodiment constructed as above, by arranging the built-in antenna apparatus 2200 in the upper portion of the inside of the upper housing 1102, it is enabled to make the antenna apparatus less susceptible to the influence of the human body, such as fingers, during a telephone conversation. With this arrangement, the radiation loss of the radio wave from the portable radio communication apparatus can be reduced, and the antenna gain of the built-in antenna 2200 can substantially be improved.

Advantageous Effects of Preferred Embodiments

As described in detail above, the inverted F-type antenna apparatus according to the preferred embodiments of the present invention is characterized in that the coupling element is inserted between the unbalanced type antenna element and the grounding conductor, and the connecting means for electrically connecting the antenna element with the grounding conductor in at least one place is provided.

By adjusting the amount of coupling between the antenna element and the coupling element, the amount of coupling between the antenna element and the grounding conductor or the amount of coupling between coupling element and the grounding conductor by means of the coupling element, the resonance frequency of the antenna element provided with the coupling element is made to be different from the resonance frequency of the antenna element provided with no coupling element. With this arrangement, a wideband frequency characteristic can be obtained. Moreover, the resonance frequency of the antenna apparatus can be adjusted by shifting in correspondence with a plurality of frequency bands. Moreover, by providing the connecting means common to either the feeding conductor or the short-circuit conductor, structural simplification can be achieved, and this leads to suitability for mass production.

Furthermore, by providing the slit or the slot, the resonance frequency can be reduced, and the amount of coupling between the antenna element and the coupling element and/or the grounding conductor can be adjusted. By inclining the coupling element with respect to the antenna element or the connection conductor or by providing the coupling element or the antenna element with a stepped portion, the amount of coupling between the antenna element and the grounding conductor can be adjusted.

By arranging the antenna apparatus constructed as above inside of the upper housing of the folding type portable radio communication apparatus, it can be expected to make the antenna apparatus less susceptible to the influence from the human body, such as during a telephone conversation, and the radiation loss due to the human body can be reduced.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An inverted F-type antenna apparatus comprising:

a grounding conductor;

an antenna element arranged with said grounding conductor so as to face said grounding conductor;

at least one coupling element provided between said grounding conductor and said antenna element so as to face said grounding conductor and said antenna element;

first connection means for electrically connecting said antenna element with said grounding conductor at least in one place; and second connection means for electrically connecting said antenna element with said at least one coupling element at least in one place, wherein a connecting point of said second connection means is arranged near a connecting point of said first connecting means.

2. The inverted F-type antenna apparatus as claimed in claim 1, wherein said grounding conductor, said antenna element and said at least one coupling element are arranged so as to be substantially parallel to each other.

3. The inverted F-type antenna apparatus as claimed in claim 1, wherein said antenna element and said grounding conductor are arranged so that a distance between said antenna element and said grounding conductor at an end portion where said antenna element and said grounding conductor are electrically connected with each other by said first connection means is different from a distance between said antenna element and said grounding conductor at another end portion located opposite to said end portion.

4. The inverted F-type antenna apparatus as claimed in claim 3, wherein said at least one coupling element is arranged so as to be inclined with respect to said grounding conductor.

5. The inverted F-type antenna apparatus as claimed in claim 1, wherein said antenna element has a shape curved along a configuration of a housing for accommodating said inverted F-type antenna apparatus.

6. The inverted F-type antenna apparatus as claimed in claim 1, wherein at least one of said at least one coupling element and said antenna element is provided with a bent portion.

7. The inverted F-type antenna apparatus as claimed in claim 1, wherein said grounding conductor is provided with a bent portion.

8. The inverted F-type antenna apparatus as claimed in claim 1, wherein a length of a sum total of lengths of two mutually different sides of said grounding conductor is equal to or smaller than a quarter of a wavelength corresponding to a lowest frequency band among frequency bands which are used by a portable radio communication apparatus that employs said inverted F-type antenna apparatus.

9. The inverted F-type antenna apparatus as claimed in claim 1, wherein dimensions of said antenna element and said at least one coupling element are set so that the connecting point of said second connection means is substantially located in a portion of an anti-node of a current standing wave generated in said antenna element and said at least one coupling element, and said at least one coupling element operates as a quarter-wave length resonator when said inverted F-type antenna apparatus is excited by a radio signal of a predetermined wavelength.

10. The inverted F-type antenna apparatus as claimed in claim 1, wherein said second connection means comprises a common feeding conductor electrically connecting said antenna element and said at least one coupling element with each other.

11. The inverted F-type antenna apparatus as claimed in claim 1, wherein said second connection means comprises a common short-circuit conductor electrically connecting said antenna element and said at least one coupling element with each other.

12. The inverted F-type antenna apparatus as claimed in claim 1, wherein said antenna element has a slit formed therein to adjust a resonance frequency of said inverted F-type antenna apparatus.

13. The inverted F-type antenna apparatus as claimed in claim 1, wherein said at least one coupling element has a slit formed therein to adjust a resonance frequency of said inverted F-type antenna apparatus.

14. The inverted F-type antenna apparatus as claimed in claim 1, wherein said antenna element has a slot formed therein to adjust a resonance frequency of said inverted F-type antenna apparatus.

15. The inverted F-type antenna apparatus as claimed in claim 1, wherein said at least one coupling element has a slot formed therein to adjust a resonance frequency of said inverted F-type antenna apparatus.

16. The inverted F-type antenna apparatus as claimed in claim 1, wherein an amount of electromagnetic coupling between said antenna element and said grounding conductor is adjusted by changing an area of at least one of said antenna element and said at least one coupling element.

17. The inverted F-type antenna apparatus as claimed in claim 1, further comprising a dielectric filling in at least a part of an internal portion of said inverted F-type antenna apparatus.

18. The inverted F-type antenna apparatus as claimed in claim 1, wherein dimensions of said antenna element and said at least one coupling element are set so that said inverted F-type antenna apparatus resonates in a plurality of frequency bands.

19. A portable radio communication apparatus comprising:

an upper housing;

a lower housing;

a hinge portion for coupling said upper housing with said lower housing; and an inverted F-type antenna apparatus, said inverted F-type antenna apparatus comprising:

a grounding conductor;

an antenna element arranged with said grounding conductor so as to face said grounding conductor;

at least one coupling element provided between said grounding conductor and said antenna element so as to face said grounding conductor and said antenna element;

first connection means for electrically connecting said antenna element with said grounding conductor at least in one place; and second connection means for electrically connecting said antenna element with said at least one coupling element at least in one place, wherein a connecting point of said second connection means is arranged near a connecting point of said first connection means, and wherein said inverted F-type antenna apparatus is arranged inside of said upper housing.

20. The portable radio communication apparatus as claimed in claim 19, further comprising a monopole antenna.

21. An inverted F-type antenna apparatus comprising:

a grounding conductor;

an antenna element arranged with said grounding conductor so as to face said grounding conductor;

at least one coupling element provided between said grounding conductor and said antenna element so as to face said grounding conductor and said antenna element;

first connection means for electrically connecting said antenna element with said grounding conductor at least in one place; and second connection means for electrically connecting said antenna element with said at least one coupling element at least in one place, wherein a connecting point of said second connection means is arranged near a feeding point on said antenna element.

22. The inverted F-type antenna apparatus as claimed in claim 21, wherein said grounding conductor, said antenna element and said at least one coupling element are arranged so as to be substantially parallel to each other.

23. The inverted F-type antenna apparatus as claimed in claim 21, wherein said antenna element and said grounding conductor are arranged so that a distance between said antenna element and said grounding conductor at an end portion where said antenna element and said grounding conductor are electrically connected with each other by said first connection means is different from a distance between said antenna element and said grounding conductor at another end portion located opposite to said end portion.

24. The inverted F-type antenna apparatus as claimed in claim 23, wherein said at least one coupling element is arranged so as to be inclined with respect to said grounding conductor.

25. The inverted F-type antenna apparatus as claimed in claim 21, wherein said antenna element has a shape curved along a configuration of a housing for accommodating said inverted F-type antenna apparatus.

26. The inverted F-type antenna apparatus as claimed in claim 21, wherein at least one of said at least one coupling element and said antenna element is provided with a bent portion.

27. The inverted F-type antenna apparatus as claimed in claim 21, wherein said grounding conductor is provided with a bent portion.

28. The inverted F-type antenna apparatus as claimed in claim 21, wherein a length of a sum total of lengths of two mutually different sides of said grounding conductor is equal to or smaller than a quarter of a wavelength corresponding to a lowest frequency band among frequency bands which are used by a portable radio communication apparatus that employs said inverted F-type antenna apparatus.

29. The inverted F-type antenna apparatus as claimed in claim 21, wherein dimensions of said antenna element and said at least one coupling element are set so that the connecting point of said second connection means is substantially located in a portion of an anti-node of a current standing wave generated in said antenna element and said at least one coupling element, and said at least one coupling element operates as a quarter-wave length resonator when said inverted F-type antenna apparatus is excited by a radio signal of a predetermined wavelength.

30. The inverted F-type antenna apparatus as claimed in claim 21, wherein said second connection means comprises a common feeding conductor electrically connecting said antenna element and said at least one coupling element with each other.

31. The inverted F-type antenna apparatus as claimed in claim 21, wherein said second connection means comprises a common short-circuit conductor electrically connecting said antenna element and said at least one coupling element with each other.

32. The inverted F-type antenna apparatus as claimed in claim 21, wherein said antenna element has a slit formed therein to adjust a resonance frequency of said inverted F-type antenna apparatus.

33. The inverted F-type antenna apparatus as claimed in claim 21, wherein said at least one coupling element has a slit formed therein to adjust a resonance frequency of said inverted F-type antenna apparatus.

34. The inverted F-type antenna apparatus as claimed in claim 21, wherein said antenna element has a slot formed therein to adjust a resonance frequency of said inverted F-type antenna apparatus.

35. The inverted F-type antenna apparatus as claimed in claim 21, wherein said at least one coupling element has a slot formed therein to adjust a resonance frequency of said inverted F-type antenna apparatus.

36. The inverted F-type antenna apparatus as claimed in claim 21, wherein an amount of electromagnetic coupling between said antenna element and said grounding conductor is adjusted by changing an area of at least one of said antenna element and said at least one coupling element.

37. The inverted F-type antenna apparatus as claimed in claim 21, further comprising a dielectric filling in at least a part of an internal portion of said inverted F-type antenna apparatus.

38. The inverted F-type antenna apparatus as claimed in claim 21, wherein dimensions of said antenna element and said at least one coupling element are set so that said inverted F-type antenna apparatus resonates in a plurality of frequency bands.

39. A portable radio communication apparatus comprising:

an upper housing;

a lower housing;

a hinge portion for coupling said upper housing with said lower housing; and an inverted F-type antenna apparatus, said inverted F-type antenna apparatus comprising:

a grounding conductor;

an antenna element arranged with said grounding conductor so as to face said grounding conductor;

at least one coupling element provided between said grounding conductor and said antenna element so as to face said grounding conductor and said antenna element;

first connection means for electrically connecting said antenna element with said grounding conductor at least in one place; and second connection means for electrically connecting said antenna element with said at least one coupling element at least in one place, wherein a connecting point of said second connection means is arranged near a feeding point on said antenna element; and wherein said inverted F-type antenna apparatus is arranged inside of said upper housing.

40. The portable radio communication apparatus as claimed in claim 39, further comprising a monopole antenna.

* * * * *